US006229384B1

(12) United States Patent
Ohsawa

(10) Patent No.: US 6,229,384 B1
(45) **Date of Patent: *May 8, 2001**

(54) SEMICONDUCTOR INTEGRATED CIRCUIT CONTAINING POWER VOLTAGE REGULATING CIRCUIT WHICH EMPLOYS DEPLETION-TYPE TRANSISTOR

(75) Inventor: Takashi Ohsawa, Yokohama (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/030,779

(22) Filed: Feb. 26, 1998

(30) Foreign Application Priority Data

Feb. 28, 1997 (JP) ..... 9-046812

(51) Int. Cl.[7] ..... G05F 1/10

(52) U.S. Cl. ..... 327/541; 327/543

(58) Field of Search ..... 327/530, 538, 327/540, 541, 542, 543

(56) References Cited

U.S. PATENT DOCUMENTS 4,614,882 * 9/1986 Parker et al. ..... 307/443
5,757,226 * 5/1998 Yamada et al. ..... 327/541
5,910,924 * 6/1999 Tanaka et al. ..... 365/226

FOREIGN PATENT DOCUMENTS 6-208791 7/1994 (JP) .

* cited by examiner

*Primary Examiner*—Jung Ho Kim
(74) *Attorney, Agent, or Firm*—Banner & Witcoff, Ltd.

(57) ABSTRACT

The depletion-type N-channel MOS transistor regulates to lower an external power voltage, and thus generates an internal power voltage for the chip. The threshold voltage monitoring circuit detects the threshold voltage of the depletion-type N-channel MOS transistor. The differential amplifying circuit which constitutes the inverse amplifying circuit, together with resistances having the same resistance value, inverts and amplifies the threshold voltage of the depletion-type N-channel MOS transistor, detected by the threshold voltage monitoring circuit. The output voltage of the differential amplifying circuit is supplied to the gate of the deletion-type N-channel MOS transistor. The threshold voltage of the depletion-type N-channel MOS transistor is compensated with the output voltage from the differential amplifying circuit, and thus the internal power voltage is maintained at constant.

35 Claims, 15 Drawing Sheets

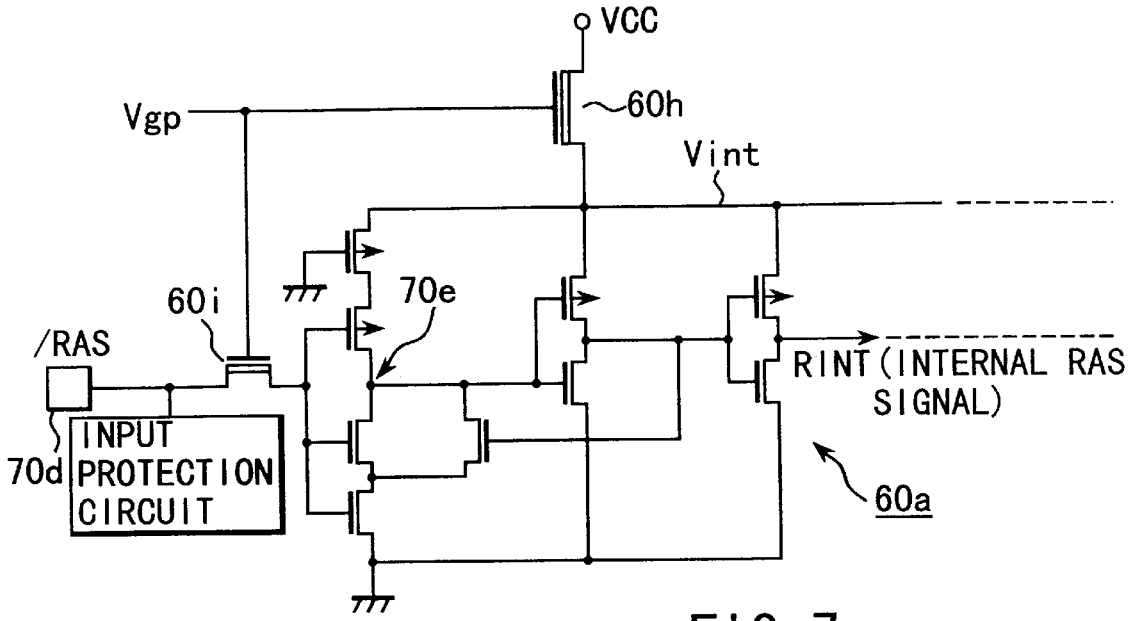
FIG. 7
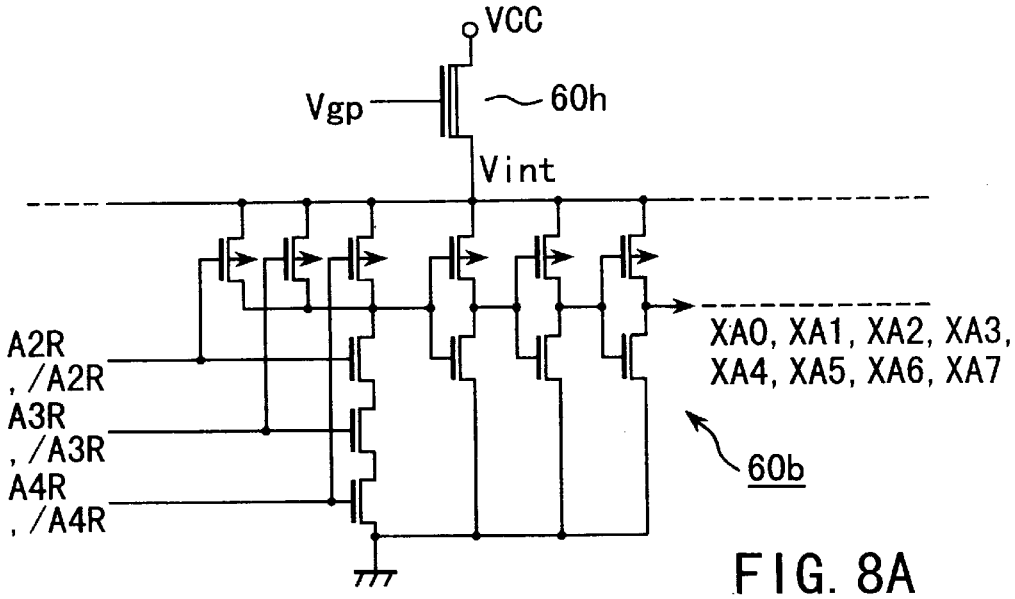
FIG. 8A
| | | | |
|---|---|---|---|
| XA0 | /A2R | /A3R | /A4R |
| XA1 | A2R | /A3R | /A4R |
| XA2 | /A2R | A3R | /A4R |
| XA3 | A2R | A3R | /A4R |
| XA4 | /A2R | /A3R | A4R |
| XA5 | A2R | /A3R | A4R |
| XA6 | /A2R | A3R | A4R |
| XA7 | A2R | A3R | A4R |
FIG. 8B

| | | |
|---|---|---|
| WDRVn0 | /AOR | /A1R |
| WDRVn1 | AOR | /A1R |
| WDRVn2 | /AOR | A1R |
| WDRVn3 | AOR | A1R |

SEMICONDUCTOR INTEGRATED CIRCUIT CONTAINING POWER VOLTAGE REGULATING CIRCUIT WHICH EMPLOYS DEPLETION-TYPE TRANSISTOR

BACKGROUND OF THE INVENTION

The present invention relates to a power voltage regulating circuit applied to a semiconductor integrated circuit, and more specifically, to a power voltage regulating circuit applied to a large-scale integrated circuit which employs a transistor having a channel length of about 0.2 micron or less, from the 256 M bit dynamic RAM (DRAM)-generation onwards.

Since the 16 M generation, the DRAM has been employing a technique in which an external power voltage Vcc is regulated within it's chip, to an internal power voltage Vint which is lower than Vcc, and thus regulated voltage is supplied to each circuit. The reason for the DRAM employing such a technique is as follows. That is, the effective channel length Leff of the transistor has been shortened these days. If an external power Vcc is applied directly to such a transistor, the characteristics of the element are deteriorated, and more specifically, for example, the threshold voltage Vth is varied and the transconductance Gm is lowered. As a result, there is a great possibility that the DRAM would become defective within 10 years.

Conventionally, as a power voltage regulating circuit of a DRAM, a circuit shown in FIG. 18 or 19 is shown. The circuit shown in FIG. 18 is a type which generates an internal power voltage Vint from an external power Vcc with use of a p-channel MOS transistor serving as voltage regulating transistor, and in this circuit, the gate of the p-channel MOS transistor 180 is controlled with a comparison output from a comparator 183. The comparator 183 compares a reference potential VREF and a potential obtained by dividing an internal power voltage Vint by resistances 181 and 182, with each other. The reference potential VREF is a constant voltage which is not dependent on temperature or an external power voltage, and VREF is generated by using, for example, a band-gap reference circuit in the chip. The comparator 183 is designed to pull the internal power voltage Vint back to the set value by turning on the p-channel MOS transistor 180, in the case where the internal power voltage Vint becomes lower than the preset value.

FIG. 19 shows a circuit designed to generate an internal power voltage Vint from an external power voltage Vcc with use of a threshold voltage Vth of an n-channel MOS transistor 191 serving as a voltage regulating transistor. The gate electrode of the n-channel MOS transistor 191 is set to Vint+Vth. With regard to the operation bias for the n-channel MOS transistor, the source voltage is as high as the internal power voltage Vint. Therefore, due to the substrate bias effect, the threshold voltage Vth becomes as high as about 1.5V, and therefore the gate potential of the n-channel transistor 191 must be set to Vint+about 1.5V, for example, when Vint=2.5V, the gate potential must be set to about 4V. In the case where the power voltage Vcc is 3.3V, this 4V voltage must be increased within the chip, which require a pump circuit 192 including an oscillator which is not shown. In addition, even if the threshold voltage Vth varies, the internal power voltage Vint must be maintained at the preset value. Therefore, the gate voltage must be a potential obtained by compensating the threshold voltage Vth. In order to achieve this, a potential which is lower than the gate potential by the threshold voltage Vth, is generated by the n-channel MOS transistor 193, and another potential is obtained by dividing thus generated potential with resistances 194 and 195, to be compared with the reference potential VREF by a comparator 196. Then, the gate potential is varied to Vth by driving the pump circuit 192. In this manner, it is designed such that the internal voltage Vint is not influenced by the variance of the threshold voltage Vth.

Any of the above-described voltage regulating circuits are already used in practice for those up to 64 M bit DRAM, and therefore they are practically proved to be fully applicable. However, in the case of the circuit shown in FIG. 18, when the gate potential of the p-channel MOS transistor 180 used for reducing the voltage, drops to zero, in other words, when the potential of Vint is decreased lower than the preset value as a load current flow to the internal circuit, the power voltage Vcc is applied between the gate and source electrodes of the transistor 180. In the case of the circuit shown in FIG. 19, the gate of the p-channel MOS transistor used for reducing the voltage, will have a voltage no less than the power voltage Vcc, and therefore a high voltage is applied to the pump circuit 192 for generating the high voltage not less than the power voltage, or to the gate of the n-channel MOS transistor which constitutes a capacitor 197 shown in the figure. However, as will be explained later, there is a sufficient allowance with regard to the withstand voltage of the insulating film, and when the effective channel length Leff of each of these elements is set longer than those of Leff of the other circuits, a hot carrier resistance for the voltage regulating circuit itself can be made assured, making it possible to maintain the reliability of the entire DRAM.

In the case of DRAMs from the 256 M bit generation onwards, it is considered that a sufficient reliability of the device cannot be assured with the power voltage regulating circuit in some cases. This is because, as the size of the element becomes finer, the factors for the reliability of the device, change. More specifically, up to the generation of the 64 M bit DRAM, the withstand voltage by the hot carrier determines the reliability of the device, whereas from the generation of the 256 M bit DRAM onwards, the reliability of the DRAM is determined by the withstand voltage error of the insulating film of the transistor, rather than the above factor.

FIG. 20 illustrates how the power voltage Vcc and the internal power voltage Vint change as the size of the DRAM becomes fine, along with the hot carrier voltage $VB_{HC}$ and the insulating film withstand voltage $V_{TDDB}$. As is clear from this figure, from the 1 M bit DRAM to 4 M bit DRAM, both the hot carrier withstand voltage and insulating film withstand voltage are higher than the external power voltage Vcc, and therefore the decrease in voltage is not required. By contrast, in the case of the 16 M bit DRAM, for an external power voltage Vcc=5V, the hot carrier withstand voltage $VB_{HC}$ becomes lower than Vcc, and therefore if Vcc is used as the power for the circuit, the hot carrier is generated, thus causing the variation of Vth or Gm (=Ids/Vgs). As a result, the life of the DRAM, which is set to 10 years or longer as its specification, cannot be satisfied. In order to avoid this, the voltage regulating circuit is provided within the DRAM, and the method in which the external power voltage Vcc is lowered to the level of the internal power voltage Vin by the voltage regulating circuit and then supplied to a desired circuit, is employed. Naturally, since Vcc is applied to the voltage regulating circuit itself, the transistor which constitutes this circuit is formed to have a large effective channel length Leff, so as to improve the hot carrier withstand voltage. This is also the case for the 64 M bit DRAM.

However, for the generation of the 256 M bit DRAM, that the withstanding voltage of the insulating film of the transistor becomes insufficient with regard to the power voltage Vcc, in addition to the aspect of the hot carrier withstand voltage. Therefore, it becomes no longer possible to apply the conventional technique, in which an internal power voltage Vint is generated with use of a voltage regulating circuit shown in FIGS. 18 to 19, and only the effective channel length of the device is elongated, so as to assure a sufficient hot carrier withstand voltage. More specifically, in the case where a circuit is formed of a transistor having a gate oxide film thickness (tox) of 60 angstroms, for a withstand voltage of the insulating film of 4.5 MV/cm (if an electrical field stronger than this is applied to the insulating film, the insulating film becomes defective within 10 years of use of this device), a voltage of 2.7 or higher cannot be applied between the gate and channel of the transistor. In order to avoid this, the voltage supplied to the circuit should be lowered from an external voltage of 3.3V to 2.7V; however in the voltage regulating circuit shown in FIGS. 18 or 19, the transistor itself, which is a part of the device, receives that 3.3V, and the withstand voltage error may be easily created at this part.

Conventionally, it suffices only if the hot carrier withstand voltage is considered, and the problem of which can be solved by increasing the effective channel length for the transistor. However, in order to lower the voltage for maintaining the withstand voltage of the insulating film, the thickness of the gate oxide film of the transistor of the voltage regulating circuit must be increased. In this case, not the approach in terms of design, that is, increasing the effective channel length, but the approach in terms of processing, that is, forming two types of transistors having different insulating films, is required. Such an approach for the process entails an increase in the number of processing steps, or an increase in the yield of the product due to the deterioration of the controllability of the process, which causes a great increase in the production cost.

The basic solution to the above problem is naturally to lower the external power voltage itself; however in practice, the power voltage cannot be so easily decreased due to a great number of limitations as the system.

BRIEF SUMMARY OF THE INVENTION

The object of the present invention is to provide a semiconductor integrated circuit including a power voltage regulating circuit, capable of improving the withstand voltage of its transistor substantially, without increasing the thickness of the gate insulating film.

The object of the present invention can be achieved by the following structures.

A semiconductor integrated circuit comprising: a voltage regulating transistor consisting of a depletion-type N-channel MOS transistor including a current path having one end to which an external power voltage is supplied, and an other end connected to an internal circuit; and a control circuit for generating a gate voltage for the voltage regulating transistor, the control circuit supplying the gate voltage to a gate of the voltage regulating transistor, the voltage regulating transistor generating an internal power voltage lower than the external power voltage used in the internal circuit, from the external power voltage.

Further, a semiconductor integrated circuit comprising: a voltage regulating transistor consisting of a depletion-type N-channel MOS transistor including a current path having one end to which an external power voltage is supplied, and an other end connected to an internal circuit; and a control circuit for generating a gate voltage for the voltage regulating transistor, supplying the gate voltage to a gate of the voltage regulating transistor, the voltage regulating transistor generating an internal power voltage lower than the external power voltage used in the internal circuit from the external power voltage.

Furthermore, a semiconductor integrated circuit comprising: a voltage regulating transistor consisting of a depletion-type N-channel MOS transistor including a current path having one end to which an external signal is supplied, and an other end connected to an internal circuit; and a control circuit for generating a gate voltage for the voltage regulating transistor, supplying the gate voltage to a gate of the voltage regulating transistor, the voltage regulating transistor generating an internal signal lower than the external signal used in the internal circuit from the external signal.

Furthermore, a semiconductor integrated circuit comprising: a voltage regulating transistor consisting of a depletion-type N-channel MOS transistor including a current path having one end to which an external power voltage is supplied, and an other end connected to an internal circuit; and a control circuit for generating a gate voltage for the voltage regulating transistor and supplying the gate voltage to a gate of the voltage regulating transistor, the voltage regulating transistor generating an internal power voltage lower than the external power voltage used in the output circuit in accordance with the gate voltage supplied from the control circuit, wherein the output circuit includes: a first N-channel MOS transistor for outputting a low-level voltage for a final stage; and a second N-channel MOS transistor inserted between the first N-channel MOS transistor and an input/output terminal, and the output circuit serves to supply the internal power voltage to a gate of the second N-channel MOS transistor.

Furthermore, a semiconductor integrated circuit comprising: a voltage regulating transistor consisting of a depletion-type N-channel MOS transistor including a current path having one end to which an external power voltage is supplied; and a control circuit for generating a gate voltage for the voltage regulating transistor, supplying the gate voltage to a gate of the voltage regulating transistor, the voltage regulating transistor generating a high-level potential of a word line lower than the external power voltage.

Furthermore, a semiconductor integrated circuit comprising: a memory circuit provided in a chip; a logic circuit arranged in the chip; a first voltage regulating transistor consisting of a depletion-type N-channel MOS transistor including a current path having one end to which an external power voltage is supplied, and an other end connected to the memory circuit; a second voltage regulating transistor consisting of a depletion-type N-channel MOS transistor including a current path having one end to which an external power voltage is supplied, and an other end connected to the logic circuit; and a control circuit for generating gate voltages for the first and second voltage regulating transistors and supplying the gate voltages to gates of the first and second voltage regulating transistors, the first and second voltage regulating transistors generating internal power voltages used in the memory circuit and the logic circuit, respectively, from the external power voltage, in accordance with the gate voltage supplied from the control circuit.

Furthermore, a semiconductor integrated circuit comprising: a voltage regulating transistor consisting of a depletion-type N-channel MOS transistor including a current path having one end to which an external power voltage is supplied, and an other end for outputting an internal power voltage for the semiconductor integrated circuit; and a control circuit for generating a gate voltage obtained by compensating a variation of a threshold voltage of the voltage regulating transistor, on a basis of a reference voltage, and supplying the compensated gate voltage to a gate of the voltage regulating transistor.

To summarize, the present invention is a source follower type power voltage regulating circuit, which utilizes a depletion type N-channel MOS transistor. According to the present invention, in order to fix a lowered voltage (power voltage within chip: Vint) at a constant value regardless of the threshold voltage Vth of the depletion type N-channel MOS transistor, the gate voltage of the transistor is varied along with Vth. Consequently, Vint can be fixed at constant and the threshold voltage Vth of the depletion type N-channel MOS transistor can be compensated. The conventional power voltage regulating circuit is effective only for increasing the hot carrier resistance by decreasing the power voltage. However, such a conventional technique cannot be applied in order to improve the withstand voltage of the gate insulating film. The present invention is characterized by the feature that an external voltage Vcc is not applied even to the voltage regulating circuit itself, and therefore it is fully applicable to a transistor of the generation of the 256 M bit DRAM onwards, nemely, devices in which not only hot carrier withstand voltage but also insulating film cannot withstand the external power voltage Vcc.

With the present invention, the following advantages can be obtained.

That is, in the present invention, an external power voltage is lowered by the voltage regulating circuit containing a depletion type transistor, and then a lowered voltage is supplied to an internal circuit. With this structure, there is provided a semiconductor integrated circuit which is highly reliable even if such a high external power voltage that cannot assure the reliability of the transistor, is applied thereto.

Further, the voltage regulating circuit is formed with use of a depletion-type transistor, and therefore it is not necessary to prepare gate oxide films of different thicknesses for a transistor of the voltage regulating circuit, and another transistor. Therefore, an increase in the number of manufacturing steps can be avoided.

The case where a depletion type transistor is formed has advantages that the manufacture of the device is easier and the yield is higher, as compared to the conventional case where two types of transistors having different thicknesses of the insulating film are formed.

Especially, as in the case of a semiconductor integrated circuit having a size of 0.2 micron or less, in which the insulating film of the transistor cannot withstand the external power voltage, the conventional voltage regulating circuit becomes unusable. However, with use of the voltage regulating circuit of the present invention, designed to lower the external power voltage and supply a lowered voltage to an internal circuit, not only the hot carrier resistance, but also the withstand voltage of the insulating film can be assured without increasing the effective channel length.

With use of the power voltage regulating circuit of the present invention, the insulating film of the transistor of the semiconductor integrated circuit can be made thinner, and therefore the size of the transistor can be made finer. Therefore, a high-speed operation semiconductor integrated circuit can be realized.

With use of the voltage regulating circuit of the present invention, the gate oxide film thickness of the transistor which constitutes the memory can be made the same as the gate oxide film thickness of the transistor which constitutes the logic circuit. With this structure, the transistor of a memory can be designed to have a high performance from the beginning. Therefore, in the case where a memory and a logic circuit are merged, common transistors can be used. Consequently, the designing of a semiconductor integrated circuit in which a memory and a logic circuit are merged, can be facilitated.

Even if the external power voltage of the semiconductor integrated circuit is lowered due to a change in specification in the future, circuits can be commonly designed by setting the lowered voltage corresponding to an expected external power voltage, and therefore a semiconductor integrated circuit applicable for low voltage can be manufactured as a product immediately. With use of the power voltage regulating circuit of the present invention, a semiconductor integrated circuit can be operated at the same voltage as before, and therefore the redesigning of the circuit is not necessary.

With the power voltage regulating circuit of the present invention, which is capable of lowering an external power voltage to be used, it is possible to realize a semiconductor integrated circuit having a less power.

Further, when a high level potential of a word line is lowered to a value lower than the external power voltage Vcc, a highly reliable and high-speed DRAM which is suitable in mix with a logic circuit, can be designed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a circuit diagram showing an example of an input section shown in FIG. 6;

FIG. 8A is a circuit diagram showing an example of a row circuit shown in FIG. 6;

FIG. 8B is a diagram illustrating the operation of the circuit shown in FIG. 8A;

DETAILED DESCRIPTION OF THE INVENTION

Embodiments of the present invention will now be described with reference to accompanying drawings.

Figure 1:
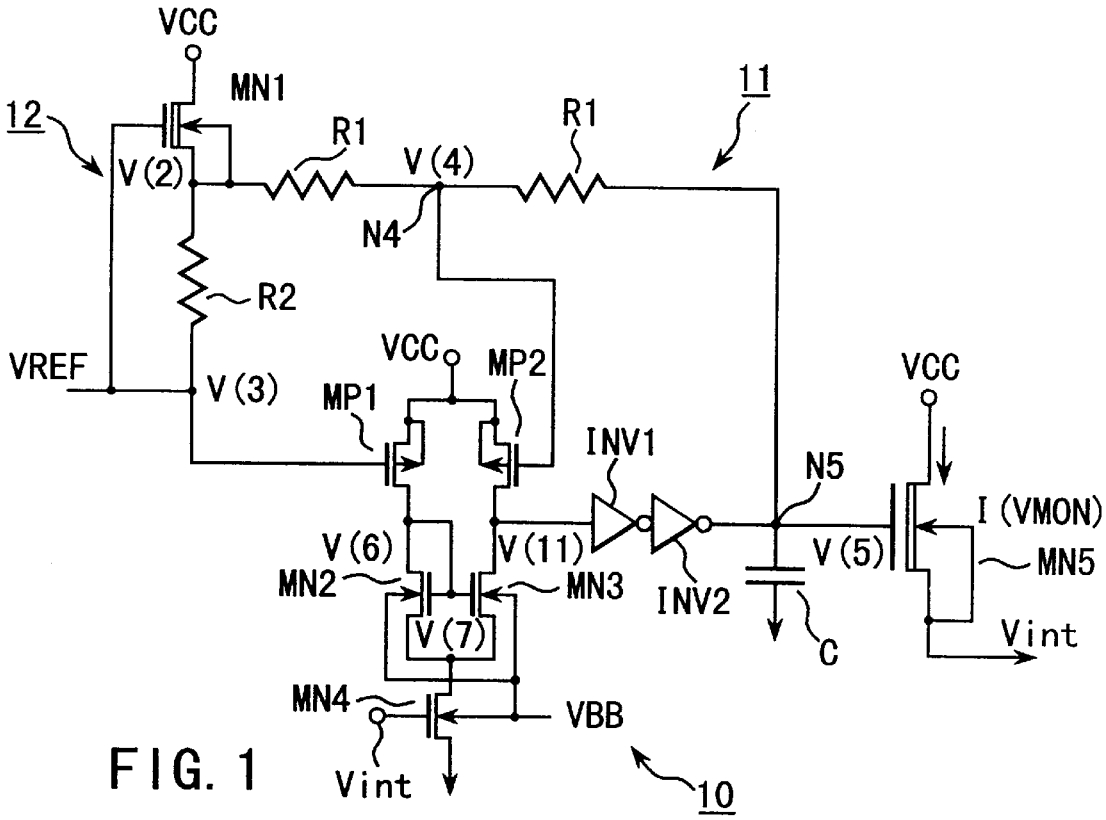
FIG. 1 is a circuit diagram showing a power voltage regulating circuit according to the first embodiment of the present invention.

FIG. 1 illustrates the first embodiment of the present invention. Transistors MN1 and MN5 are depletion type (D-type) N-channel MOS transistors, which have negative threshold voltages. The transistor MN5 has a channel width wider than that of the transistor MN1. The transistor MN5 is a voltage regulating transistor which generates an internal power voltage Vint from a power voltage Vcc. Where the threshold voltage of the transistor MN5 is represented by Vth and the gate voltage is represented by V(5), the equation, Vint=V(5)−Vth, can be established. However, the transistor MN5 is of the D-type, and therefore the threshold voltage Vth thereof has a negative value, and the internal power voltage Vint becomes higher than the gate voltage V(5). Reversely saying, the gate voltage V(5) becomes lower than the internal power voltage Vint by the absolute value of the threshold voltage Vth.

What is important in the regulating method is the controllability of the level of the internal power voltage Vint. The characteristics of VLSI are that it is sensitive to a power voltage, and when the power voltage is influenced by a variation in temperature or process, not only the access time for the memory, or the like, varies in great deal, but also there is a great possibility that the synchronizing circuit or the like malfunctions. Consequently, it is desirable that the value of Vint, which is supplied as the power for the LSI, should be constant regardless of the variation in process or temperature, or even in the external power voltage Vcc if necessary. It is desired that reference voltage VREF should not vary in response to the variations in the temperature and external power voltage Vcc. The value of the VREF can be fixed at constant with use of a band gap reference potential generating circuit or the like, as in the conventional case. However, of the characteristic variations of the D-type transistor MN5, the variation in the threshold voltage Vth, in particular, must be taken case of separately in any way. Otherwise, the internal power voltage Vint varies in wide range, thus making it highly possible to cause the deterioration in the characteristics of the LSI.

In FIG. 1, circuits other than the transistor MN5 and a smoothing capacitor C connected to the gate of this transistor, are threshold voltage compensating circuits for compensating the variation in the internal power voltage Vint with respect to the threshold voltage Vth.

P-channel MOS transistors MP1 and MP2, N-channel MOS transistors MN2, MN3 and MN4, and inverter circuits INV1 and INV2 constitute a differential amplifying circuit. More specifically, an external power voltage Vcc is supplied to the source and back gate of each of the transistors MP1 and MP2. The drains of the transistors MP1 and MP2 are connected respectively to the drains of the N-channel MOS transistors MN2 and MN3. The gates of the transistors MN2 and MN3 are connected to the drain of the transistor MN2, and the source of each transistor is grounded via the N-channel MOS transistor MN4. An internal power voltage Vint is supplied to the gate of the transistor MN4, and a back gate bias VBB is supplied to the back gate of this transistor MN4 and to the backgates of the transistors MN2 and MN3. The drains of the transistors MP2 and MN3 are connected to the gate of the transistor MN5 via a series of the inverter circuits INV1 and INV2. The gate of the transistor MN5 grounded via a capacitor C. The internal power voltage Vint is supplied to the back gate of the transistor MN5.

The circuit consisting of a D-type N-channel MOS transistor MN1 and a resistor R2, makes up a threshold voltage monitoring circuit 12 for monitoring a threshold voltage for the D-type N-channel MOS transistor. The drain of the transistor MN1 is connected to the external power voltage Vcc, and the source thereof is connected to the gate of the transistor MP1 via the resistor R2. The reference voltage VREF is supplied to the gates of the transistors MN1 and MP1.

One end of two resistors R1, R1 connected in series, is connected to the source of the transistor MN1, and the other end is connected to the gate of the transistor MN5. Further, the connection point between the resistors R1 and R1 is connected to the gate of the transistor MP2. The resistors R1 and R1 are resistances having the same resistance value, introduced so as to use the differential amplifying circuit 10 as an inverse amplifying circuit. The resistors R1, R1 and the differential amplifying circuit constitute a threshold voltage (Vth) compensating circuit 11. The resistors R1 and R1 are made up by using, for example, a diffusion resistance or MOS transistor; however they are not limited to such a structure, but, in short, may be of any structure as long as it is a circuit element having a current/voltage converting function.

With the above-described structure, the relationship between the resistors R1, R1 and R2 must satisfy, as necessary conditions, $$R1 >> R2 \quad (1)$$

and the output impedance of the circuit (not shown) for generating the reference voltage VREF is sufficiently lower than the resistor R2.

The operation of the circuit will now be described.

Figure 2A:
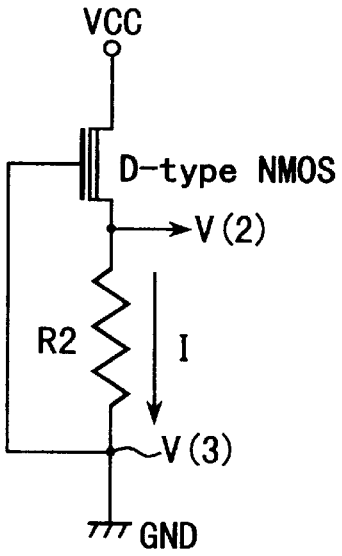
FIG. 2A is a circuit diagram showing a part of the circuit shown in FIG. 1.
Figure 2B:
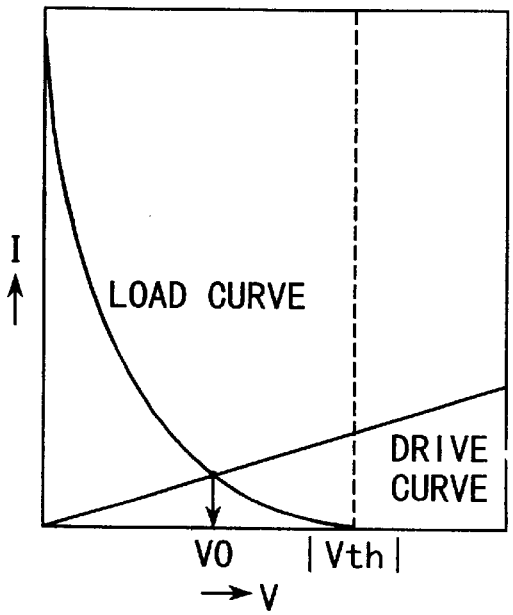
FIG. 2B is a diagram illustrating the operation of the circuit shown in FIG. 2A.

FIG. 2A shows a section of the threshold voltage monitor circuit of the D-type N-channel MOS transistor consisting of the transistor MN1 and resistor R2 shown in FIG. 1. To make the explanation simple, let us suppose that the reference voltage VREF is set to a ground potential (GND). The reference voltage VREF is, in practice, a predetermined voltage which is lower than the power voltage. FIG. 2B illustrates the load-drive curves of this circuit. As can be understood from the figure, the slope of the drive curve can be decreased by setting the resistor R2 to a sufficiently large value, and thus it is possible to make the operation point V0 where the load curve and drive curve intersect with each other, sufficiently close to the absolute value of the threshold voltage |Vth|. In practice, when the resistor R2 is set sufficiently larger than the channel resistance of the transistor MN1, the voltage V(2) can satisfy the following equation:

$$V(2)=V(3)+|Vth|=VREF+|Vth| \tag{2}$$

Further, when the value of the resistor R1 is set sufficiently higher than that of the resistor R2, the current flowing from the external power voltage Vcc through the resistor R1, can be made sufficiently smaller than the current flowing from the external power voltage Vcc through the resistor R2. In this manner, it is designed not to disturb the shape of the load-drive curves shown in FIG. 2B.

Next, the feedback group consisting of a differential amplifying circuit and two resistors R1, will now be described. These two resistors R1 serve to make the differential amplifying circuit operate as an inverse amplifying device. The circuit consisting of the transistor MP1, MP2, MN2, MN3 and MN4, and inverter circuits INV1 and INV2 is a differential amplifying circuit, which amplifies a slight potential difference between a voltage V(3) at the source of the transistor MN1 and a voltage V(4) appearing at a connection node N4 between the resistors R1 and R1, so as to generate a voltage V(5) to be outputted. The voltage V(5) is specifically expressed as:

$$V(5)=\kappa\{V(3)-V(4)\} \tag{3}$$

When the amplifying rate κ is designed to be very high, the gate voltages of the transistors MP1 and MP2 are controlled to be equal to each other, by the feedback loop shown in FIG. 1. In other words, the potential V(5) is controlled so as to satisfy the equation (4):

$$V(3)=V(4)=VREF \tag{4}$$

From the equations (2) and (4), the following relationship is established.

$$V(2)-V(4)=|Vth| \tag{5}$$

Further, the current flowing from the external power voltage Vcc through the resistance R1 to the node N4, further flows to a node N5 via the resistance R1 (that is, the currents flowing through the two resistances R1 are the same), and therefore the following relationship can be established:

$$V(4)-V(5)=V(2)-V(4) \tag{6}$$

Therefore, the voltage V(5) can be expressed from the equations (4), (5) and (6).

$$V(5)=VREF-|Vth| \tag{7}$$

As expressed with the equations, the voltage V(5) is designed to decrease when |Vth| value is increased due to the variation in the threshold voltage Vth, by the variation amount. Therefore, the internal power voltage Vint is higher than the voltage V(5) by |Vth| and therefore the following relationship can be established.

$$\begin{aligned} Vint &= V(5)+|Vth| \\ &= VREF \end{aligned} \tag{8}$$

As a result, it is understood that the internal power voltage Vint is set free from the variation in the threshold voltage of the D-type N-channel MOS transistor, and the voltage Vint is controlled to the value of the reference voltage VREF. In other words, the threshold voltage compensating circuit outputs a voltage of VREF−|Vth| to the depletion type transistor at all times regardless of the variation in threshold voltage. Therefore, the transistor MN5 outputs a reference voltage VREF. When the VREF value itself can be made constant regardless of the variation in process, temperature or external power voltage Vcc, the internal power voltage Vint can be designed to be fixed constant.

Figure 3:
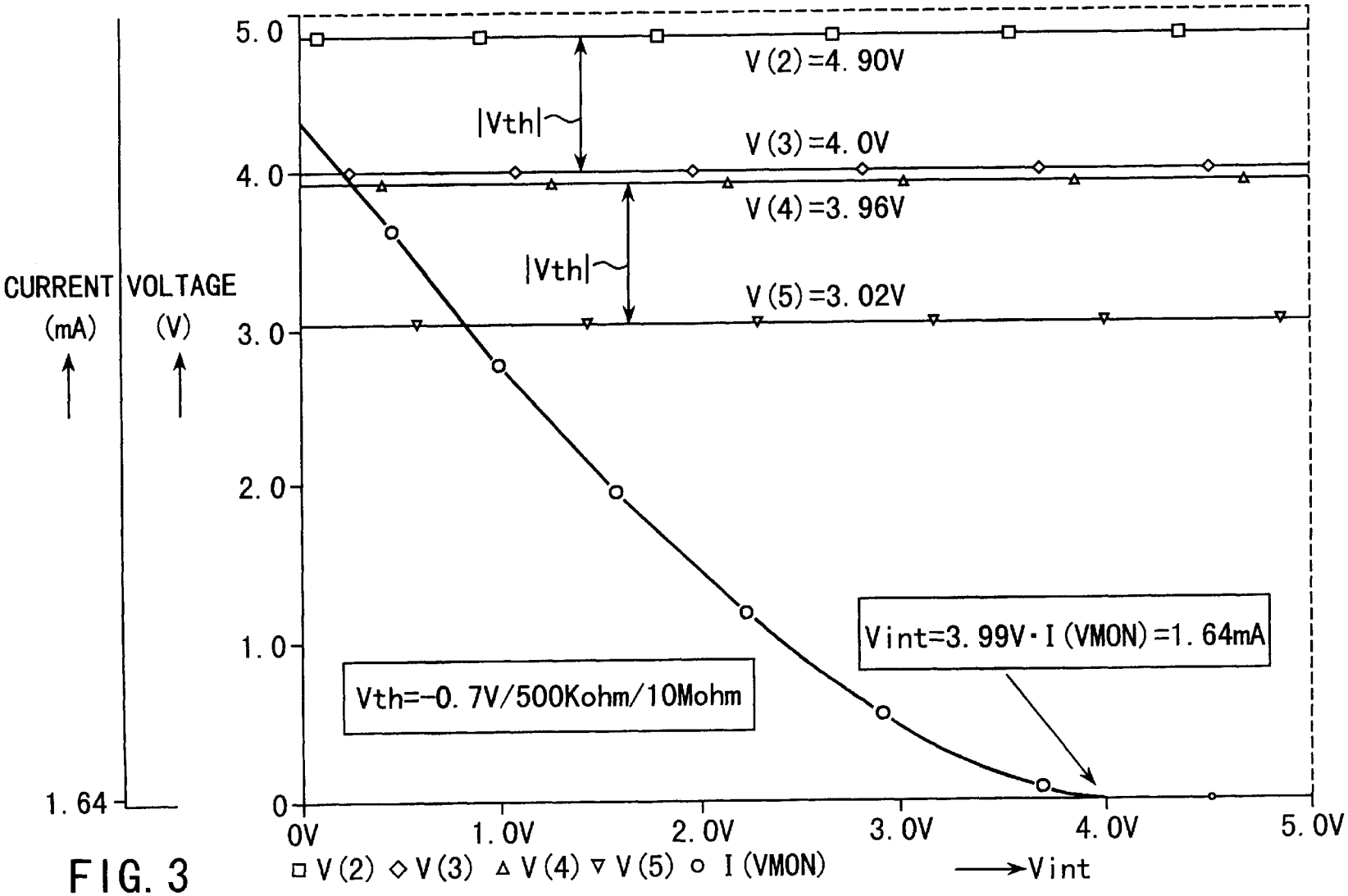
FIG. 3 is a diagram illustrating the operation of the circuit shown in FIG. 1.
Figure 4:
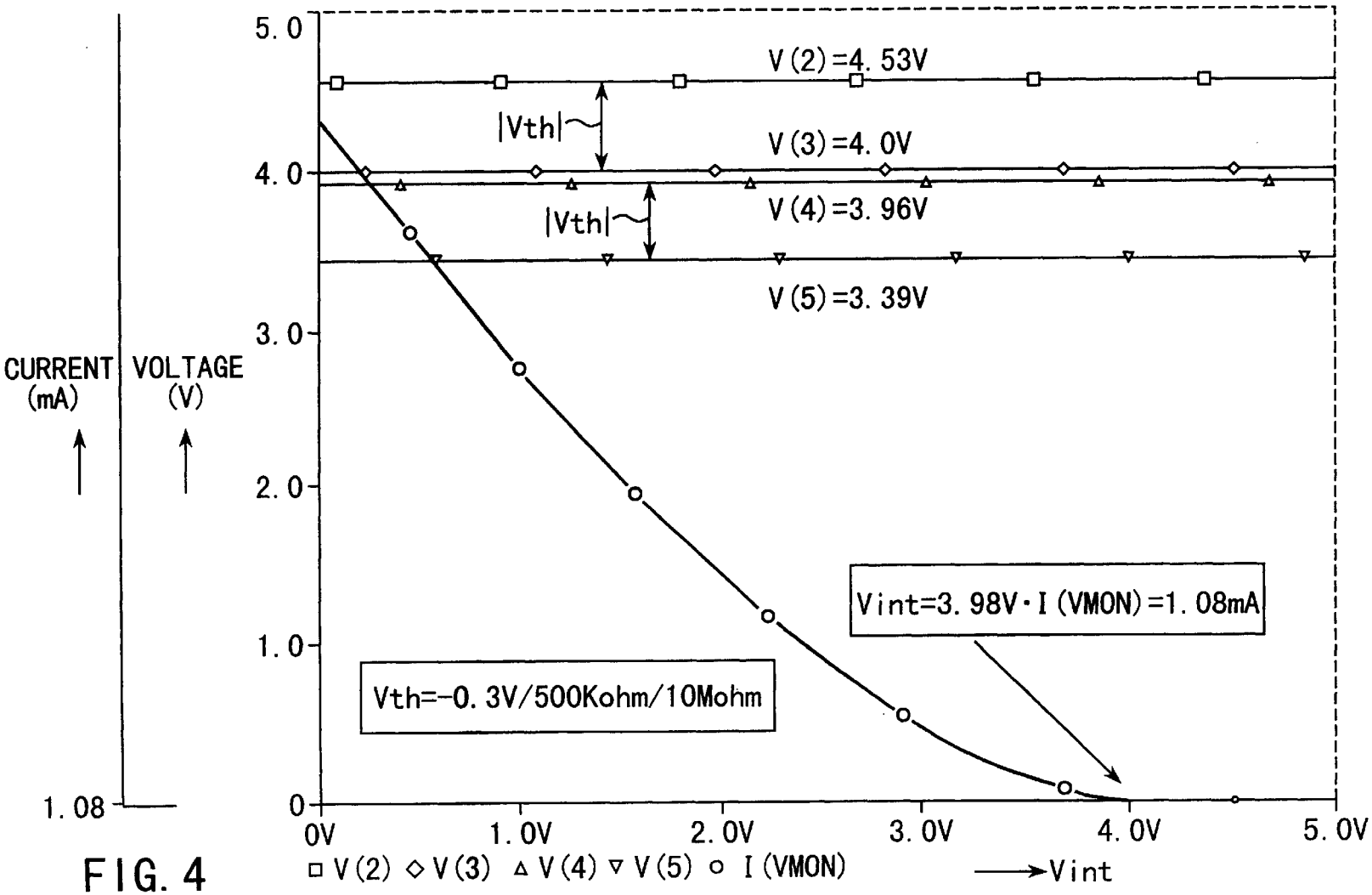
FIG. 4 is a diagram illustrating the operation of the circuit shown in FIG. 1.

FIGS. 3 and 4 each show a simulation result of the circuit shown in FIG. 1 where Vcc=5V, R1=10 MΩ, R2=10 kΩ, VREF=4V and a channel width is 1 cm. FIG. 3 illustrates the case where Vth of the D-type N-channel MOS transistor is −0.7V, whereas FIG. 4 depicts the case where it is −0.3V. As can be understood from the results shown in these figures, when Vth varies by 0.4V from the case of FIG. 3 to that of FIG. 4, the V(5) value varies by 0.37V, thus compensating Vth substantially.

The curves shown in FIGS. 3 and 4 indicate load current characteristics of Vint, obtained by monitoring the current flowing from Vcc to the voltage of Vint. Vint values which involve currents of about 1 mA (1.64 mA in FIG. 3 and 1.08 mA in FIG. 4), are 3.99V in FIG. 3 and 3.98V in FIG. 4. In other words, if the Vth value varies by about 0.4V as from the case of FIG. 3 to that of FIG. 4, the load current characteristics do not substantially change, thus making it possible to maintain the internal power voltage Vint substantially at constant.

Next, an example of designing of the power of DRAM in the case where the power voltage regulating circuit according to the first embodiment is employed, will now be described.

Figure 5:
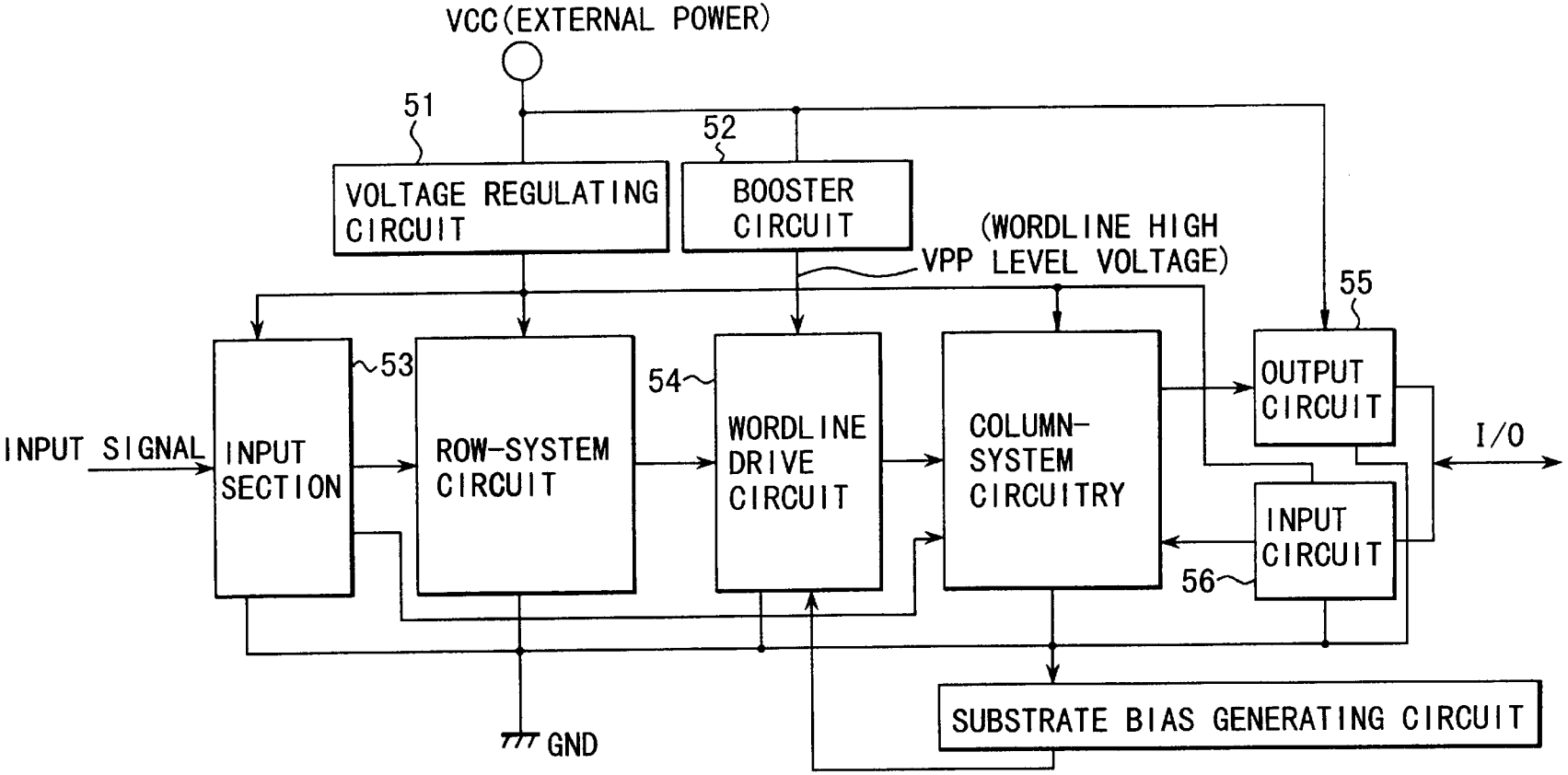
FIG. 5 is a circuit diagram showing the structure of a conventional DRAM.

First, FIG. 5 illustrates an example where a conventional power voltage regulating circuit is applied. In this circuit, a high voltage which is not less than the internal power voltage Vint, is applied to the voltage regulating circuit 51, the booster circuit 52 which creates a voltage for high level word line, an input section 53, a word line drive circuit 54, a data output circuit 55 and a data input circuit 56. The reason why a high voltage is applied to the input section 53 is that an input signal may have a voltage equal to Vcc.

Figure 6:
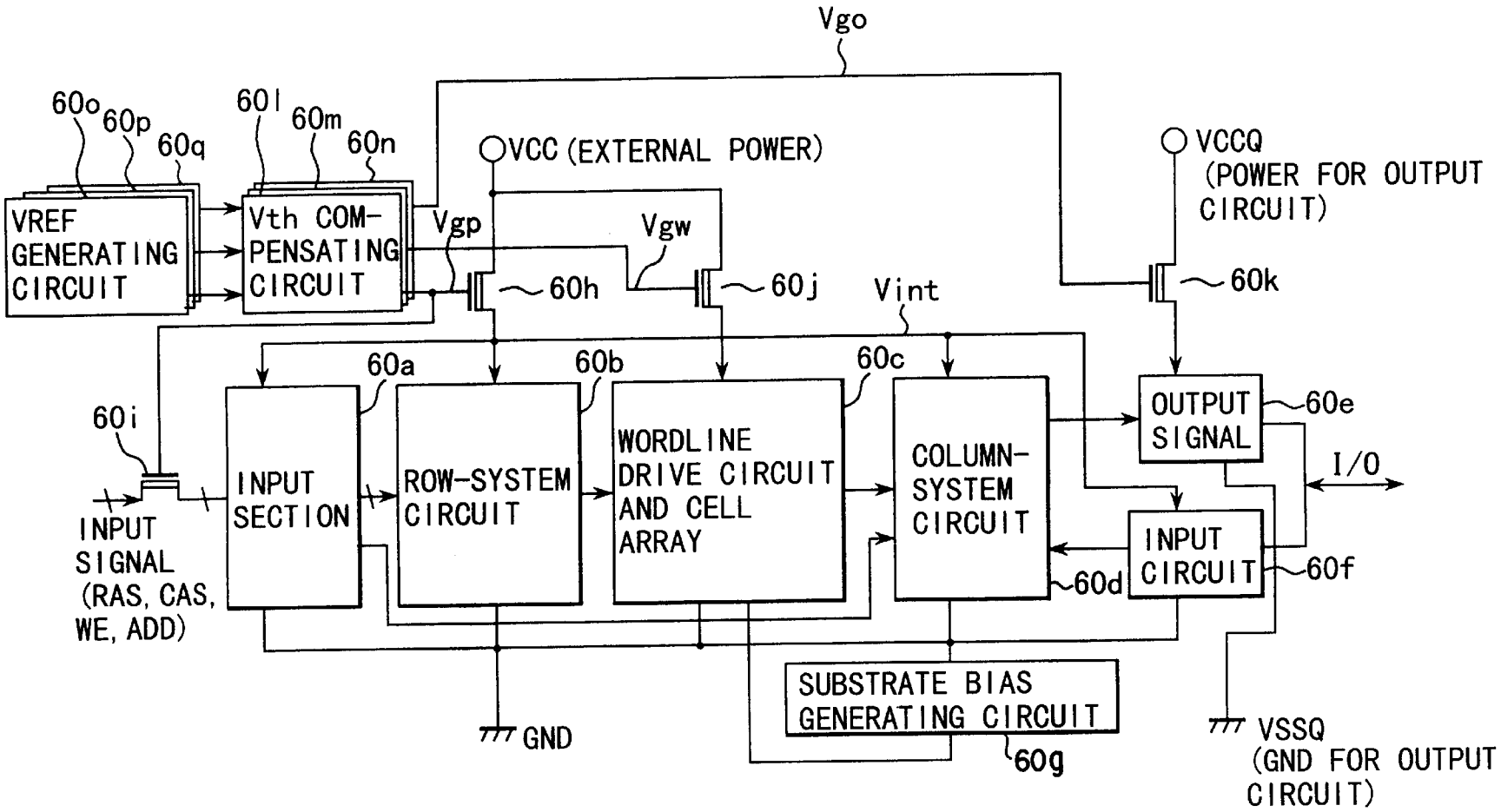
FIG. 6 is a circuit diagram showing the structure of a DRAM according to the second embodiment of the present invention.

FIG. 6 shows the second embodiment of the present invention, and illustrates the structure of a semiconductor memory device such as DRAM, in which the power voltage regulating circuit according to the first embodiment is used. The DRAM is designed with a rule of, for example, 0.2 μm or less.

The DRAM includes an input section 60*a* to which various control signals such as RAS (row address strobe), CAS (column address strobe) and WE (write enable), or address signal (ADD) are supplied, a row-system circuit 60*b* made of, for example, a predecoder for row address, a word line drive circuit, a cell array 60*c*, a column-system circuit 60*d* made of, for example, a column decoder, data output circuit 60*e* and input circuit 60*f*, commonly connected to an I/O pad which is not shown, and a substrate bias generating circuit 60*g*. The power voltage and signals are supplied to these circuits via the D-type N-channel MOS transistor. More specifically, an input signal is supplied to the input section 60*a* via the D-type N-channel MOS transistor 60*i*. The internal power voltage Vint obtained by lowering the external power voltage Vcc is supplied to the input section 60*a*, the row-system circuit 60*b*, the column-system circuit 60*d* and the data input circuit 60*f* via the D-type N-channel MOS transistor 60*h*. Further, the internal power voltage obtained by lowering the external power voltage Vcc is supplied to the word line drive circuit and cell array 60*c* via the D-type N-channel MOS transistor 60*j*, whereas the internal power voltage obtained by lowering the external power voltage VccQ for the output circuit is supplied to the data output section 60*e* via the D-type N-channel MOS transistor 60*k*.

The D-type N-channel MOS transistors 60*h* and 60*i* are controlled by a gate voltage Vgp, the transistor 60*j* is controlled by a gate voltage Vgw, and the transistor 60*k* is controlled by a gate voltage Vgo. These gate voltages are generated by threshold voltage (Vth) compensating circuits 60*l*, 60*m* and 60*n*, and reference voltage (VREF) generating circuits 60*o*, 60*p* and 60*q* connected to these compensating circuits, and generating different reference voltages. The threshold voltage compensating circuits 60*l*, 60*m* and 60*n* and the reference voltage generating circuits 60*o*, 60*p* and 60*q* each have a similar structure to that shown in FIG. 1. The reason why different gate voltages are used for these D-type transistors, is that the internal power voltage may be different from one circuit to another, although, naturally, the ideal case in terms of reliability and consumption power, is that all the internal power voltages are equal to each other. However, the reference voltage generating circuits 60*o*, . . . , 60*q*, and the threshold voltage compensating circuits 60*l*, . . . , 60*n* may be separated from each other in accordance with the structure of each circuit, or may be co-used in each circuit.

In the case where Vth may not be completely compensated, or it is not so different, it is possible that different gate voltages are generated from one Vth compensating circuit. More specifically, in the circuit shown in FIG. 1, a potential is taken from the connection node between the resistances R1 and R1; however the potential may be taken from some other section than the connection node between the resistances R1 and R1, such as either one end of the resistances R1 and R1 connected in series. In this case, Vth is not compensated in a strict sense; however the circuit structure can be simplified.

Although not shown in FIG. 6, a gate voltage Vgb used for generating a high level voltage Vblk for bit line, is used for the sense amplifier driver, which will be described latter.

A DRAM of a recent type generally outputs a plurality of outputs such as 4, 8, 16 and 32 bits, and in the case of a multi-bit output product, the power (VccQ) and GND (VSSQ) exclusively for the output stage. Therefore, with the power voltage regulating circuit for supplying a voltage to the output circuit, the external power voltage and the lowered power voltage can be designed as a separate series from the other peripheral circuits. Such separation in designing is necessary to avoid a power noise generated when data is output, adversely affecting the operation of the peripheral circuits.

Further, an input signal to the DRAM (such as RAS, CAS, WE, OE, Address or Din) is considered, in some cases, to take the same value as that of the external power voltage Vcc, at maximum. Therefore, it is inevitable that a high stress is applied to the input section 60*a* which receives an input signal, if the input section 60*a* is maintained as it is. In order to avoid this, it is designed that an input signal is input not directly, but through the D-type N-channel MOS transistor 60*i* to which a gate voltage Vgp is input. With this designing, the signal input to the input section takes only the same value as Vint at maximum, thus solving the problem of the withstanding voltage.

Further, although it is not directly connected to the present invention, in a conventional word line drive circuit or a conventional cell transfer gate transistor to which word lines are connected, a power voltage VPP, which is no less than Vcc, is supplied to cells to write a sufficient charge therein. However, the power voltage VPP may remain as the only one high voltage in the DRAM. In order to avoid this, it is considered as a solution that the substrate bias effect of the cell transfer gate is decreased and the signal amplification of the bit line is suppressed, so as to decrease VPP to a level as low as possible. In a practical case where a Vcc of 3.3V is lowered to a Vint of 2.5V, it is necessary to set VREF=2.5V, Vg=2.0V (that is, the gate voltage of each depletion-type transistor), and VPP=2.7V, approximately. Such a DRAM is designed with tox=60 angstrom, as a prerequisite, the maximum electrical field Eoxmax applied on the insulating film of the transistor is expressed as follows:

$$Eoxmax=2.7\times10^{-6}\ MV/60\times10^{-8}\ \text{cm}=4.5\ MV/\text{cm} \quad (9)$$

and thus the drawback in terms of the reliability can be solved.

FIG. 6 shows an example of the circuit which is designed such that the high level voltage of the word line is set to be equal to Vint. Since a large current flows when driving a word line, a voltage regulating circuit exclusively for the word lines is provided. In the case where it is desired to set the high level for a word line, at a slightly higher, for example, 2.7V with respect to Vint=2.5, a node is drawn from the middle of the resistance R1 located closer to the connection node N5 of the circuit shown in FIG. 1, for example, and the voltage at the node is input to the gate, thus making it possible to change the value.

FIG. 7 shows the structure of the input section 60*a*. This figure illustrates an input buffer circuit (Schmmidt trigger input buffer circuit) for /RAS (row address strobe) signals. To this circuit block, an internal power voltage Vint obtained by lowering Vcc using the D-type N-channel MOS transistor 60*h* (having a gate potential of Vgp) for lowering voltage, is supplied. Further, an input signal /RAS is not input directly to the gate of the input stage, but to the gates of the P-channel and N-channel transistors which constitute an inverter circuit 70*e* through the D-type N-channel MOS transistor 60*i*. With this structure, even if an input signal /RAS supplied to a pad 70*d* has the level of Vcc or higher, a voltage of only Vgp+|Vth|, which is equal to Vint, (where Vth is threshold voltage of D-type transistor) is applied to the gate of the inverter at the input stage. Therefore, the reliability of the insulating film of each transistor can be fully satisfied.

FIG. 8A shows the structure of the row circuit 60*b*. FIG. 8A illustrates a predecoder for row address. This circuit serves to create address signals XA0 to XA7 to be input to a row decoder, from 3 addresses A2R, A3R and A4R. There are 7 sets of circuits of this type, and the inputs of the addresses correspond to the outputs as listed in the table shown in FIG. 8B. This row circuit is of a typical type, and is established using a power obtained by lowering Vcc to Vint using the regulating transistor 60*h* (having a gate potential of Vgp) which is common to peripheral circuits.

Figures 9A, 9B:
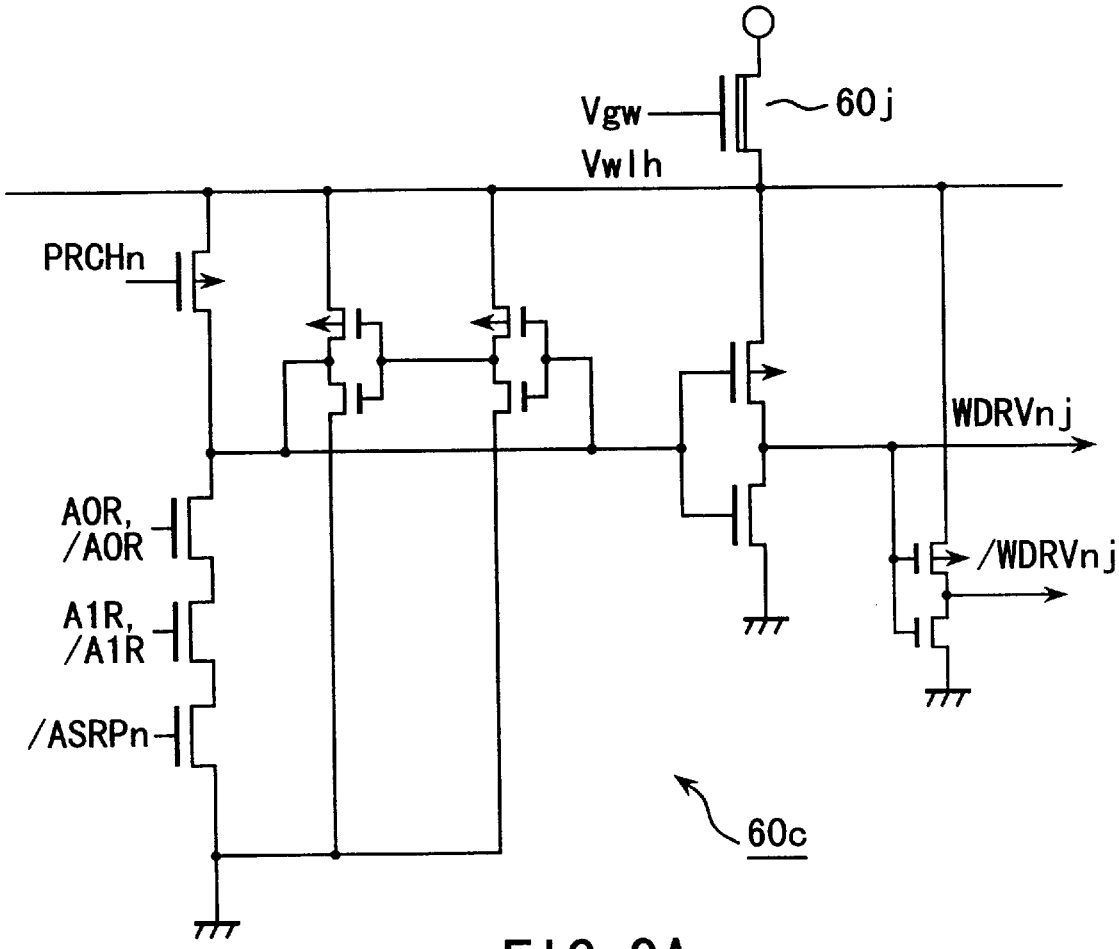
FIG. 9A is a circuit diagram showing a word line drive circuit and an example of a cell array, shown in FIG. 6.
FIG. 9B is a diagram illustrating the operation of the circuit shown in FIG. 9A.
Figure 10:
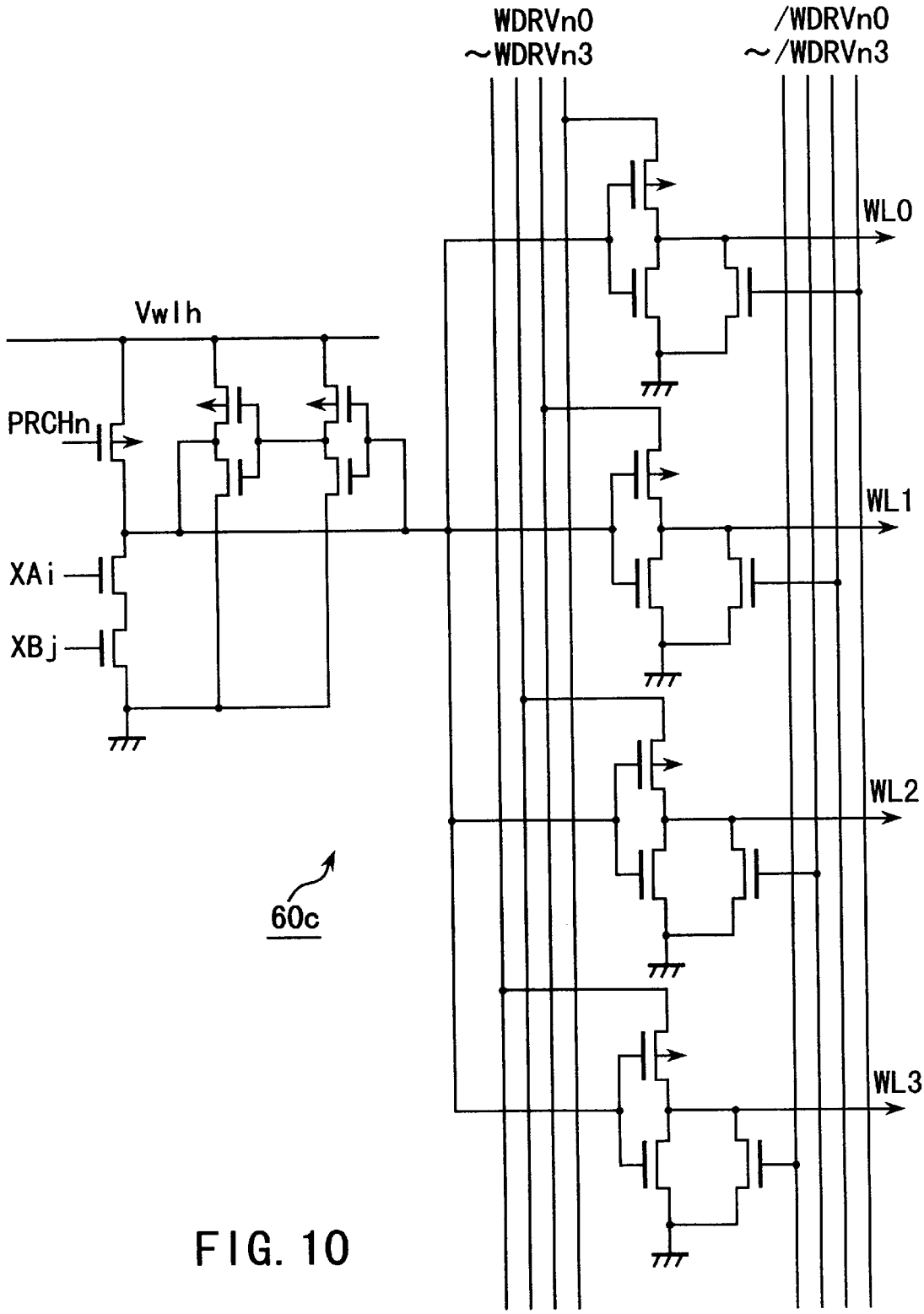
FIG. 10 is a circuit diagram showing a word line drive circuit and an example of a cell array, shown in FIG. 6.

FIGS. 9A, 9B and 10 show the word line drive circuit and cell array 60*c*.

As can be seen in FIGS. 9A and 10, this circuit consists of a row decoder circuit (shown in FIG. 9A and the left-hand side of FIG. 10) for driving a word line, and a word line driver circuit (shown in the right-hand side of FIG. 10), and thus employing a two-step decode mode which selects a word line in two steps. More specifically, in the circuit shown in FIG. 10, one of the row decoders is selected on the basis of address signals XAi (i=0 to 7) and XBj (j=0 to 7). Each one of the row decoders is capable of selecting 4 word lines WL. Since one of WDRVn0 to WDRVn3 is already selected by the decoder circuit shown in FIG. 9A, one word line WL is finally selected.

It should be noted that PRCHn represents a precharge signal, which maintains a low level when precharging /RAS, and when /RAS is activated, the precharge signal becomes to have a high level immediately before a word line is selected. Further, /RSPn is a signal relating to redundancy. More specifically, /RSPn drops to a low level when a redundancy word line (not shown) is risen (if a row address input does not coincide an error address programmed, or no error address is programmed, this signal maintains a high level). Further, a subscript n indicates a cell array block from a plurality of them. In each block, PRCHn and /RSPn, further XAi and Xbi (though subscript is not provided) are controlled. In other words, for a cell array whose block is not selected, PRCHn is still at low level, /RSPn is still at high level and XAi and XBi are still at low level.

A voltage Vwlh is supplied to the above-described circuit as a power voltage. This voltage corresponds to the high level of the word line. The high level of the word line is determined under conditions different from those of the power voltage for the other peripheral circuit, and therefore the level must be set to a power voltage different from the power voltage Vint of the peripheral circuit. Therefore, it is necessary to provide the D-type voltage regulating transistor 60*j* for exclusive use, for obtaining a lowered voltage from the external power voltage Vcc. Therefore, a voltage Vgw input to the gate of the voltage regulating transistor 60*j* exclusive for the word line drive circuits, is different from those of the peripheral circuits.

The reason why the voltage at a word line can be lowered will now be described.

Conventionally, a word line is raised to a voltage of Vcc or higher. However, in the case of a super-small transistor of about 0.2 micron or less, a very thin film having a thickness of about 60 angstrom or less, should be used as the insulating film of the transistor so as to suppress the short channel effect (which is the phenomenon that the threshold voltage becomes smaller than the set value when the channel length is shortened, and if this phenomenon occurs, the threshold voltage becomes uncontrollable, and the transistor cannot be practically used). Consequently, even as a voltage for a word line, a voltage of Vcc or higher may not be applied in order to maintain the reliability of the insulating film. Therefore, a voltage applied to a word line must be set equal to the internal power voltage Vint of the peripheral circuit, or to, even at highest, such a voltage that cannot exceed the maximum electric field applicable to the insulating film. Ideally, the voltage should be equal to the voltage Vint.

Naturally, when the voltage applied to a word line is decreased, a voltage which can be written in a memory cell is decreased by the same amount. As a result, the signal amount of the cell decreases, possibly causing the deterioration of the refreshing property. Under these circumstances, it is important to increase CS (capacitance of memory cell) to a sufficient level.

Further, as the size of cells becomes smaller, the region for separating a transistor from another transistor, becomes smaller accordingly. Conventionally, the LOCOS method is employed for the element separation region. In this method, an oxidation preventing film such as of SiN is provided only for a region where elements such as transistors are formed, and as the silicon substrate is heat-oxidized, a thick oxide film is formed only in the element separation region. However, with this method, as is well-known, a transition region which is so-called a bird's beak (a region where an insulating film continuously varies is made between an element separation region and an element region, and the region is called so since it has a shape of bird's beak) is inevitably formed. As a result, it becomes principally impossible to perform a fine element separation, and therefore the method cannot be applied to LSIs of about 0.2 microns or less.

As an alternative to the LOCOS element separation region forming method, an STI (shallow trench isolation) method is recently employed. In the STI method, a shallow trench is formed in an element separation region of a silicon substrate, and the shallow trench is filled with $SiO_2$. With this method, an element separation region and an element region can be surely and completely separated from each other, and therefore the method is suitable for the downsizing of the element.

An advantage of this method is that there is no substrate bias effect of transistor, or very little if any. The role of the transfer gate of a cell is to confine a charge in the capacitor of the cell to preserve it when the word line is at 0V, to read it by increasing it to a high voltage, and to write a high voltage of "1" side without dropping the threshold value. Therefore, the sub-threshold current for a word line of 0V must be decreased to a sufficiently low level, and therefore the threshold voltage must be set at sufficiently high level. Consequently, at the time of read/write, the voltage of the word line must be increased to Vblh+Vth or higher (note that Vblh is a high level of BL) with respect to that high threshold voltage. Further, in the case of writing "1", the operation state of the cell transfer gate is as follows. That is, the source of the cell transfer gate is as high as a voltage Vblh, and therefore the voltage of the word line is very much higher than the threshold voltage for the case of word line voltage WL=0, due to the substrate bias effect (that is, the phenomenon in which the threshold voltage becomes higher as Vbs, namely the voltage of the substrate in relation to the source, becomes higher on the negative side). Therefore, it is necessary to increase the voltage of the word line to a higher level at least by a corresponding amount of the threshold voltage which varies due to the substrate bias effect.

As described above, the element separation method is changed from the LOCOS to STI, thus eliminating the substrate bias effect (or reducing it to a very low), and therefore the voltage of the word line can be decresed to a level lower than that of the conventional case.

Thus, because of the necessity in terms of the reliability of the transistor and the changing of the element separation region forming method, the technique of increasing the voltage of a word line higher than the external power voltage Vcc, is no longer applicable to DRAMS of about 0.2 microns or less. Therefore, it is assumed that the technique of decreasing it to Vcc or lower, rather than increasing, will be popular in the future.

Figure 11:
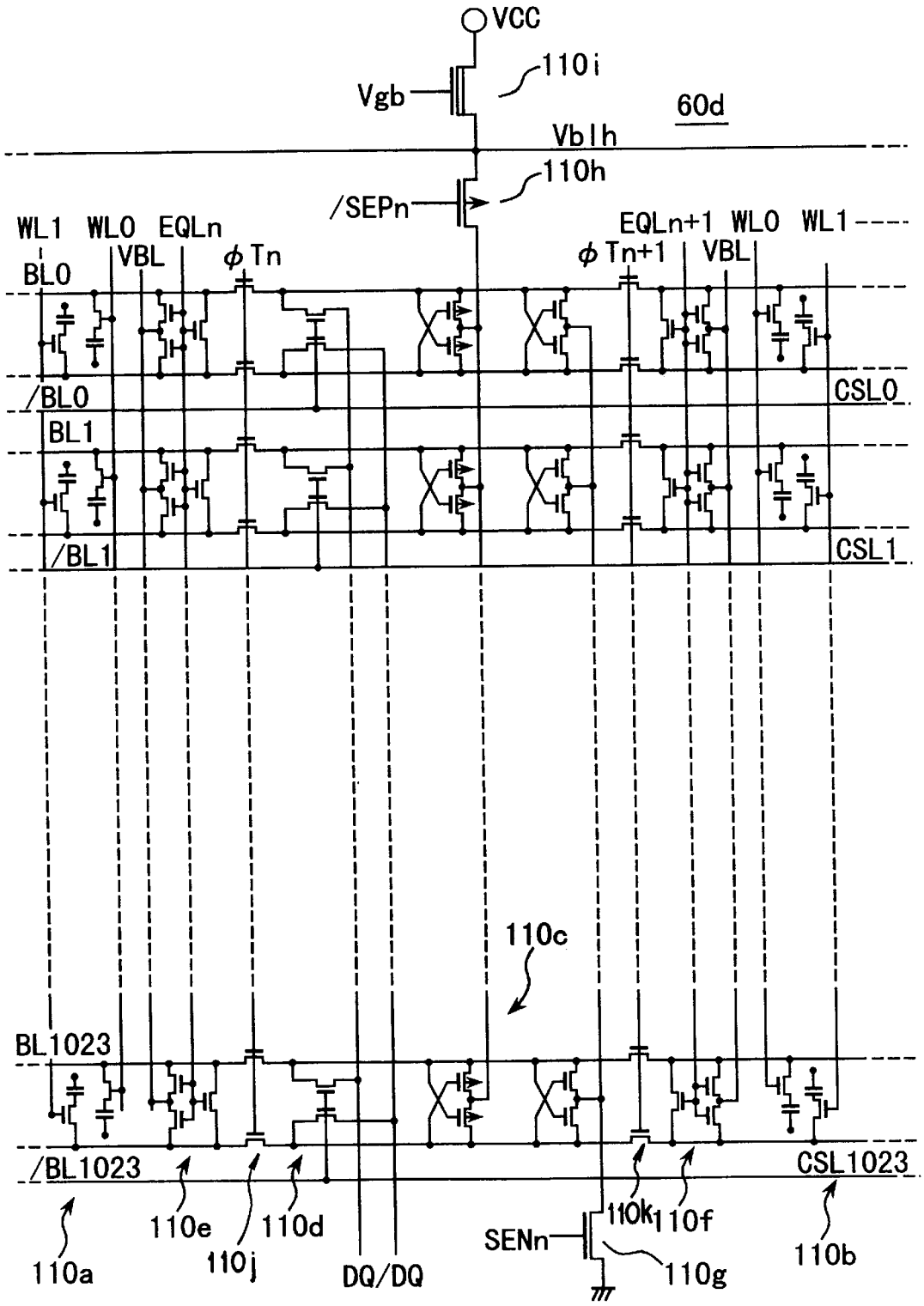
FIG. 11 is a circuit diagram showing an example of the sense amplifier driver.

FIG. 11 shows the structure of a sense amplifier driver.

As shown in FIG. 11, each of cell arrays 110*a* and 110*b* has 1024 bit line pair BL and /BL, respectively, and each of cell arrays 110*a* and 110*b* has 256 word lines (though the figure illustrates only word lines WL0 and WL1). Since the 1024 columns are of the same structure, only the structure of the column selected by column select signal CSL 1023 will now be described. The column has two bit line pairs BL and /BL, sense amplifier 110*c,* transistor pair 110*d,* bit line equalize/precharge circuits 110*e* and 110*f* and separation transistor pairs 110*j* and 110*k*. The bit line equalize/precharge circuits 110*e* and 110*f* are controlled by equalize signals EQLn and EQLn+1. The equalize signals EQLn and EQLn+1 are set at high level during the time of precharge, and drop to low level when the cell array is selected to be activated. The separation transistors 110*j* and 110*k* separate the bit line pair of each of the cell arrays from the sense amplifier 110*c* in accordance with the timing signals ϕTn and ϕTn+1. The transistor pairs 110*d* are controlled by the column select signal CSL 1023, and transfer a data sensed by the sense amplifier 110*c* to data line pair DQ and /DQ during the time of data read, and transfer data to the bit line pair during the time of the data write. VBLs supplied to the bit line equalize/precharge circuits 110*e* and 110*f* are at a precharge level of a bit line, and it is set to ½ of a voltage Vblh, which is the high level of the bit line voltage. Thus, the precharge level is:

$$VBL=(½)\times Vblh$$

ϕTn or ϕTn+1 is at high level during the time of precharge, and it maintains the high level for the selected array, and drops to the low level for the non-selected cell array on the opposite side. Thus, the bit line pair on the non-selected side is isolated from the sense amplifier. With the CSLn, one of 1024 lines is set at high level by a column decoder not shown, and amplified bit lines BL and /BL are connected respectively to the data lines DQ and /DQ, thus carrying out a read or write.

The sense amplifier 110*c* is connected to each of 1024 columns. These sense amplifiers 110*c* are made either one of a cross-coupled N-channel MOS transistor for amplifying a very fine signal appeared on a bit line pair as a word line is selected, to a voltage Vss side, and a cross-coupled P-channel MOS transistor for amplifying the very fine signal to a high level side. The sources of those sense amplifiers which consist of the N-channel MOS transistor are connected in common, and the node of this common connection is grounded via the N-channel MOS transistor 110*g* whose gate is controlled by a signal SENn. Similarly, the sources of those sense amplifiers which consist of the P-channel MOS transistor are connected in common, and to the node of this common connection, a voltage Vblh is supplied via the P-channel MOS transistor 110*h* whose gate is controlled by a signal /SEPn. The voltage Vblh is at high level, to which the voltage of a bit line is amplified finally, and this high level voltage is generated by lowering Vcc using the D-type N-channel MOS transistor 110*i*. The voltage regulating transistor 110*i* is exclusively for the voltage Vblh, and its gate voltage is set as Vgb separated from those of the peripheral circuits and the voltage regulating transistors of the word line drive circuits.

It should be noted that as a whole, the column circuit 60*d* involves an internal power voltage Vint which is lower than a general power voltage. Therefore, the high level of a bit line is set to a voltage Vblh. Thus, it suffices if the equalize signals EQLn and EQLn+1 and timing signals ϕTn and ϕTn+1 are set to voltage Vblh.

Figure 12:
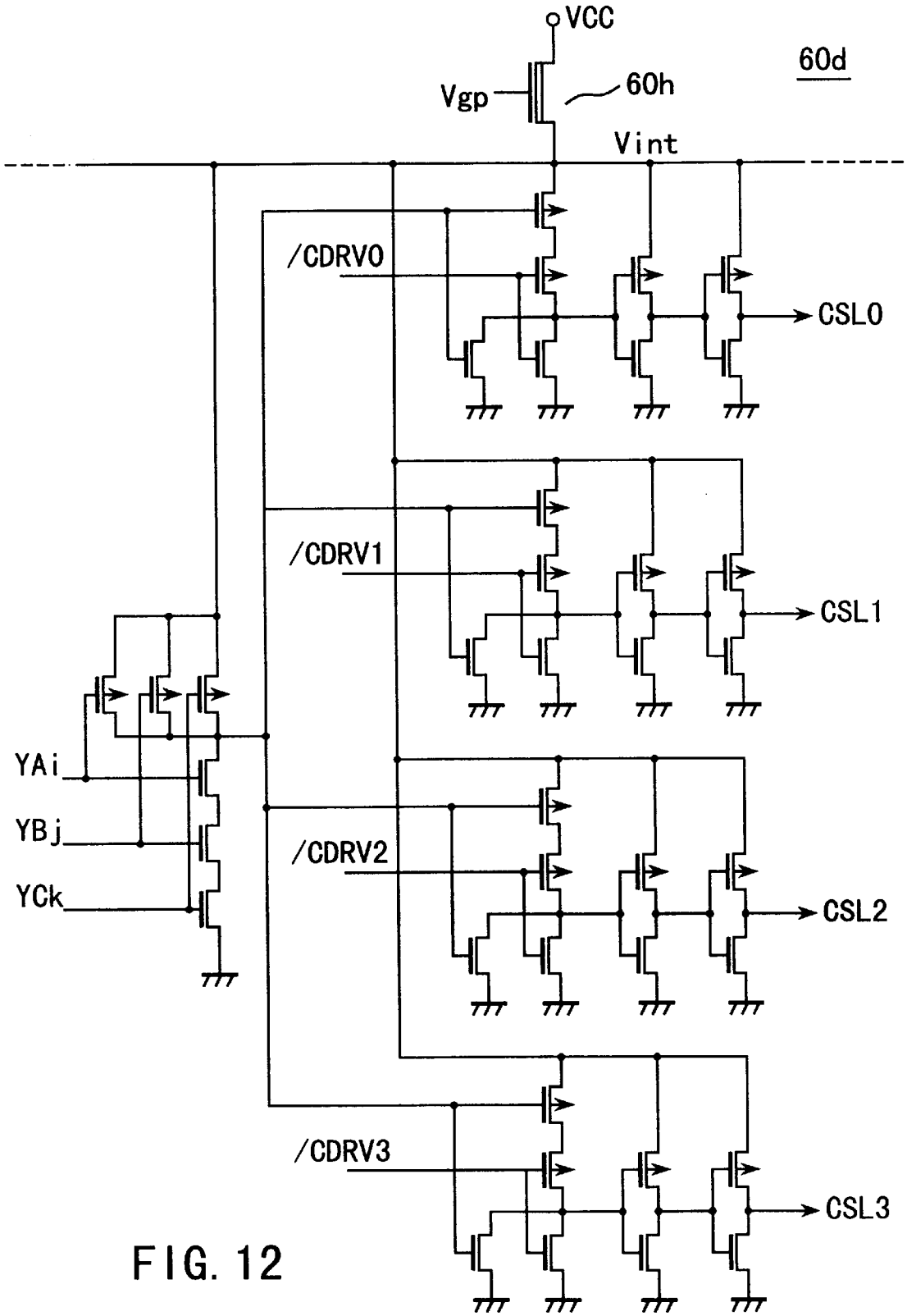
FIG. 12 is a circuit diagram showing an example of the column circuit shown in FIG. 6.

FIG. 12 shows the structure of the column circuit 60*d*.

This figure illustrates column select line decoders, which are so-called column decoder circuits. One column decoder is selected by address signals YAi (i=0 to 3) pre-decoded at column addresses A3C and A4C, address signals YBj (j=0 to 3) pre-decoded at column addresses A5C and A6C, and address signals YCk (k=0 to 3) pre-decoded at column addresses A7C and A8C. This selected column decoder still contains 4 column selection lines (CSL); however, one CSL is finally selected by /CDRV0 to /CDRV3 decoded at column addresses A1C and A2C. The power voltage is Vint, which is for peripheral circuits, and the Vint is obtained by lowering the external power voltage Vcc by the D-type voltage regulating transistor to the gate of which the voltage Vgp is applied.

Figure 13A:
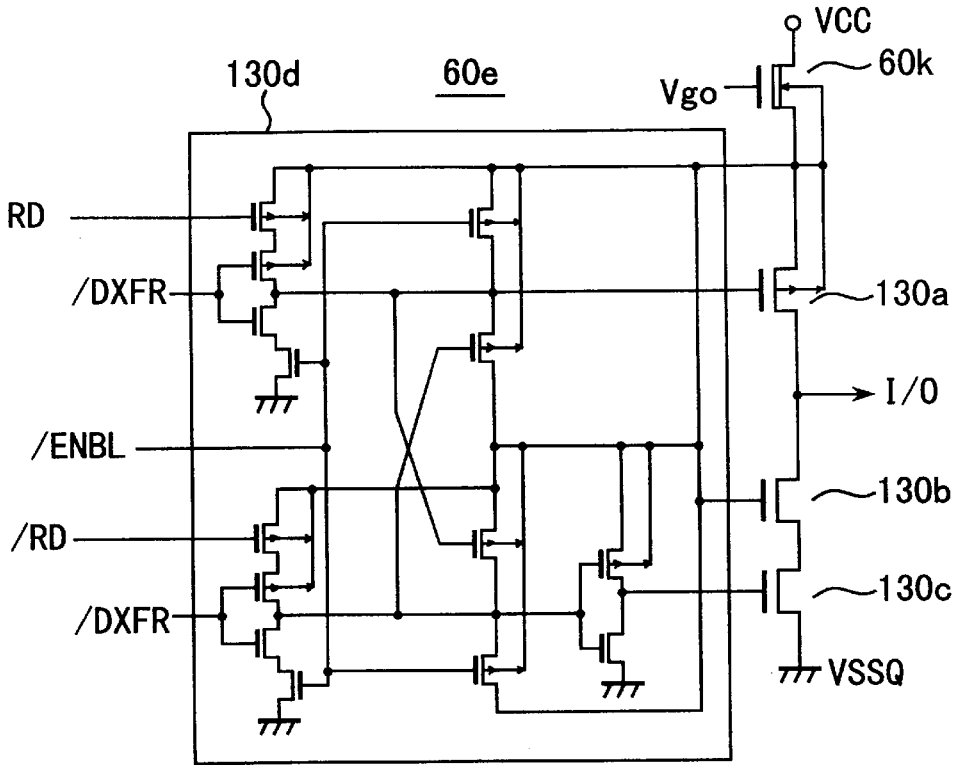
FIG. 13A is a circuit diagram showing an example of the output circuit shown in FIG. 6.

FIG. 13A shows the output circuit 60*e*.

The circuit shown in this figure is an output circuit for the I/O (input/output) common case. In the case of the multi-bit output DRAM, which is recently very popular, an input signal and an output signal are connected to a common pad. In this case, the measures taken for the input signal, as discussed in connection with FIG. 6, are not sufficient, the output circuit must be taken care of, as well. More specifically, in the final stage of the output circuit, a circuit for outputting a low level signal is formed by connecting two N-channel MOS transistors together in series, and a voltage obtained by lowering the D-type N-channel MOS transistor is applied to the gate located closer to the I/O pad. With this structure, a high electrical field being applied on the insulating film of each transistor, can be avoided even if a voltage of Vcc or higher is applied to the I/O pad.

That is, as shown FIG. 13A, the D-type voltage regulating transistor 60*k,* the P-channel MOS transistor 130*a,* the N-channel MOS transistors 130*b* and 130*c* are connected in series between the external power voltage Vcc and the ground, and the connection node between the P-channel MOS transistor 130*a* and the N-channel MOS transistor 130*b* is connected to the I/O pad (not shown). The voltage Vgo is supplied to the gate of the voltage regulating transistor 60*k,* and the lowered voltage made by the voltage regulating transistor 60*k* is supplied to each part of the control section 130*d,* as well as to the source of the P-channel MOS transistor 130*a* and the gate of the N-channel MOS transistor 130*b*. An output signal of the control section 130*d* is supplied to the gates of the P-channel MOS transistor 130*a* and N-channel MOS transistor 130*c*. The control section 130*d* is connected to read data line pair RD and /RD, a timing signal line /DXFR and an enable signal line ENBL to which an output control signal is supplied.

With the above structure, the transistor 130*b* is rendered conductive at all times by the voltage supplied from the transistor 60*k,* thus preventing the application of a voltage of Vcc level to the transistor 130*c*. Thus, the transistor 130*c* can be surely protected.

Further, in the control section 130*d,* data read from a cell accessed, is transferred to the read data line pair RD and /RD. The read data line pair RD and /RD are pre-charged at high level (Vint), and when a signal transferred thereto is a type which makes low level, that is, when a signal "1" is read, the read data line /RD drops to the ground potential, or when a signal "0" is read, the read data line RD drops to the ground potential. In synchronous with the timing of such a signal being transferred, the timing signal line /DXFR which is originally at high level (Vint level), drops to level, and the data is taken in the output circuit. Such a state is immediately propagated to a push-pull circuit consisting of the P-channel MOS transistor and the N-channel MOS transistor at the final stage, and the signal is output to the I/O pad. The timing signal line /DXFR is only rendered at low level in terms of pulse, and restores its high level. However, the data taken in the control section is latched as memory data, and therefore the line keeps on outputting the data unless the next data is taken in or the enable signal line /ENBL originally at high level, is rendered at low level. When the enable signal line /ENBL is at low level, the output terminal will have a high impedance, and to avoid this, it is required to set the enable signal line /ENBL at high level before a signal is output.

Figure 13B:
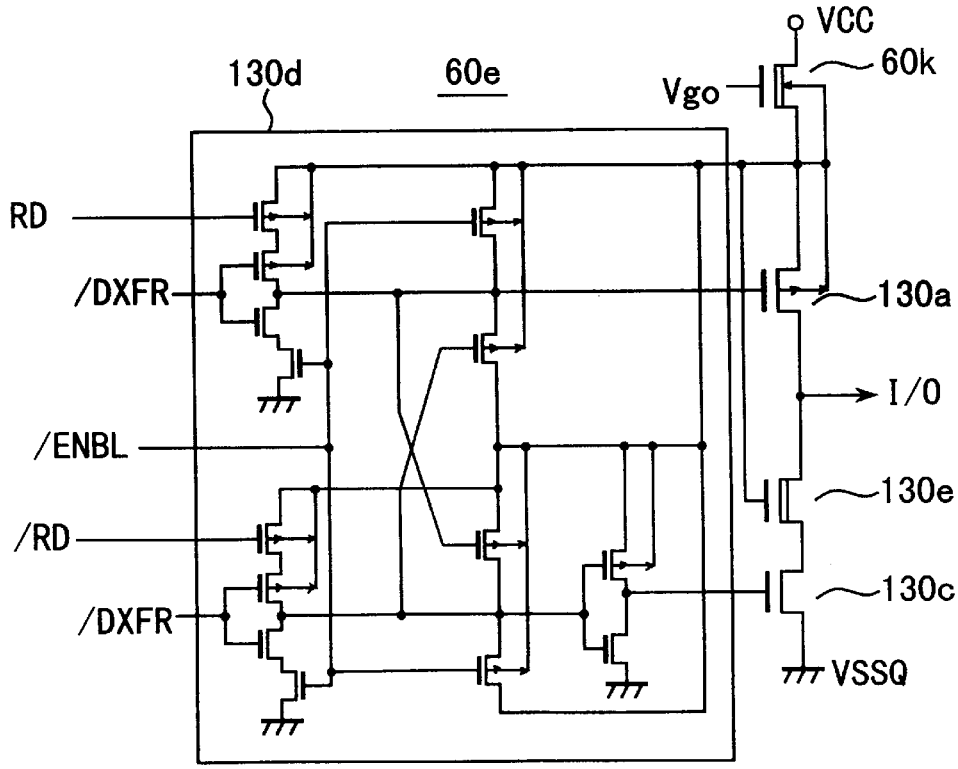
FIG. 13B is a circuit diagram showing a different version of the output circuit shown in FIG. 13A.

FIG. 13B shows a different version of the example shown in FIG. 13A, and the same elements are designated by the same reference numerals as those of FIG. 13A. In this version, between the I/O pad and the N-channel MOS transistor 130*c*, the depletion-type N-channel MOS transistor 130*e* is connected in place of the enhancement type N-channel MOS transistor 130*b*. The voltage Vgo is supplied to the gate of the N-channel MOS transistor 130*e*. With this structure, the same effect as that of the structure shown in FIG. 13A can be obtained.

Figure 14:
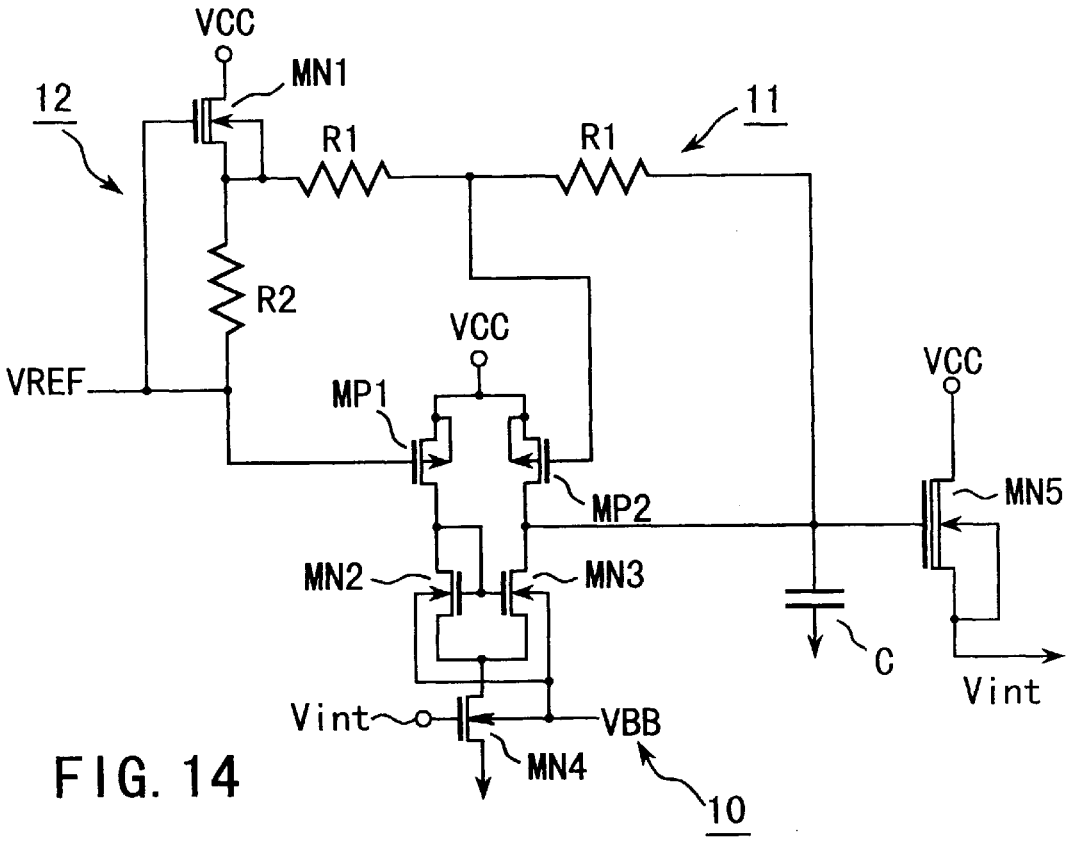
FIG. 14 is a circuit diagram showing a power voltage regulating circuit according to the third embodiment of the present invention.

FIG. 14 shows the third embodiment of the present invention, which is a different version of the first embodiment, and the same elements are designated by the same reference numerals as those of FIG. 1.

This embodiment is similar to that shown in FIG. 1 except that the inverter circuits INV1 and INV2 are excluded. The prerequisite of this structure is that the differential amplifying circuit has a large gain (output voltage/input voltage difference). In the case where the gain of the differential amplifying circuit can be set sufficiently large as described above, the inverter circuit can excluded, thus making it possible to simplify the circuit structure.

Figure 15:
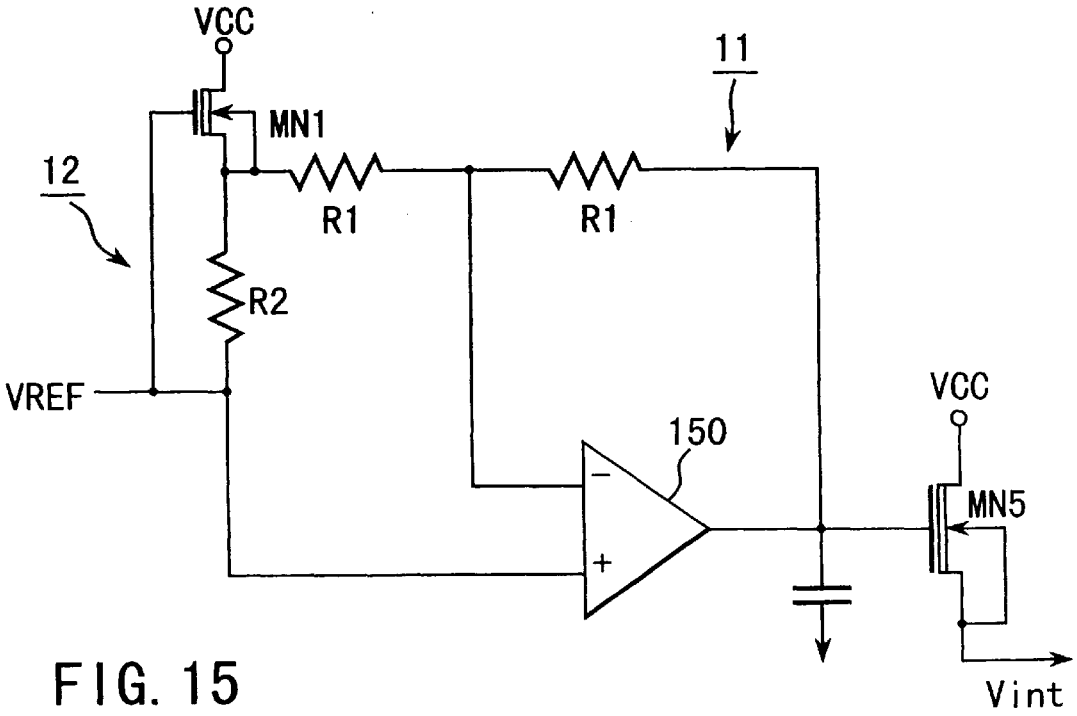
FIG. 15 is a circuit diagram showing a general differential amplifier of the power voltage regulating circuit of the present invention.

The structure of the power voltage regulating circuit is not limited to these two types, but the general type is as illustrated in FIG. 15. In this figure, a general differential amplifying circuit 150 is used, and the output terminal of the differential amplifying circuit 150 is connected to the gate of the D-type N-channel MOS transistor MN5.

Figure 16:
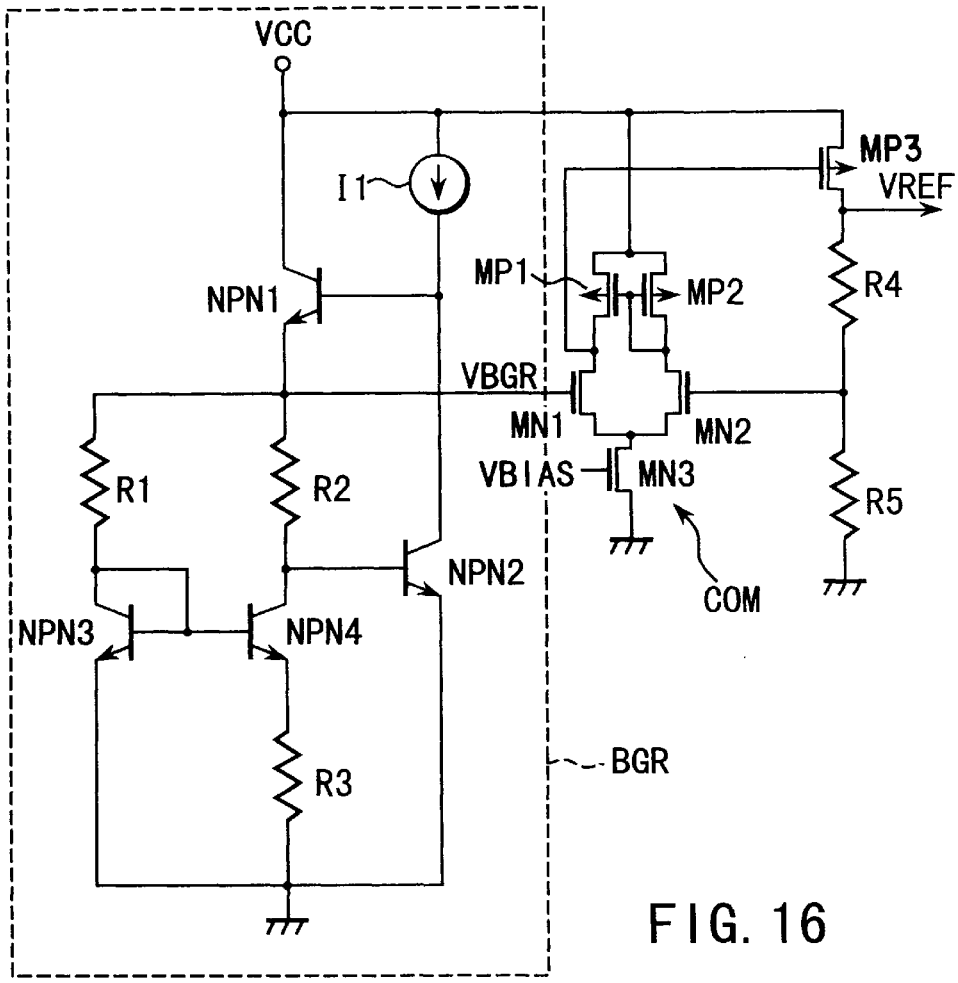
FIG. 16 is a circuit diagram showing an example of the reference voltage generating circuit applied to the power voltage regulating circuit shown in FIG. 13A.

FIG. 16 shows an example of the reference potential VREF generating circuit. This circuit comprises a band gap reference circuit BGR, a comparator COM, P-channel MOS transistor MP3 and resistors R4 and R5. The band gap reference circuit BGR consists of NPN bipolar transistors NPN1, NPN2, NPN3 and NPN4, resistors R1, R2 and R3 and a constant current power circuit I1. The comparator COM including P-channel MOS transistors MP1, MP2, and N-channel MOS transistors MN1, MN2 and MN3, and for comparing a reference potential VBGR generated from the band gap reference circuit BGR and being independent from temperature or power voltage, and a voltage obtained by dividing a reference voltage VREF with the resistors R4 and R5, with each other. The gate of the P-channel MOS transistor MP3 is controlled by an output signal from the comparator COM, and thus the reference voltage VREF is controlled to a preset value.

The voltages applied to the transistors MP1, MP2, MN1, MN2, MN3 and the voltage applied between the gate and source of the transistor MP3 are all less than Vcc and small, and therefore the insulating films of the transistors should not be damaged.

It should be noted that the band gap reference circuit is a type discussed in, for example, "Analysis and Design of Analog Integrated Circuits", P. R. Gry and R. G. Mayer, Wiley, N.Y., 1977, Chapter 4.

The structure of the reference voltage generating circuit is not limited to that shown in FIG. 16, but in place of the band gap reference circuit BGR of FIG. 16, it is also possible that a simple resistance division in which a plurality of resistances are connected in series between a power and ground, is provided, so as to render the reference voltage VREF dependent on the external power voltage Vcc.

Figure 17:
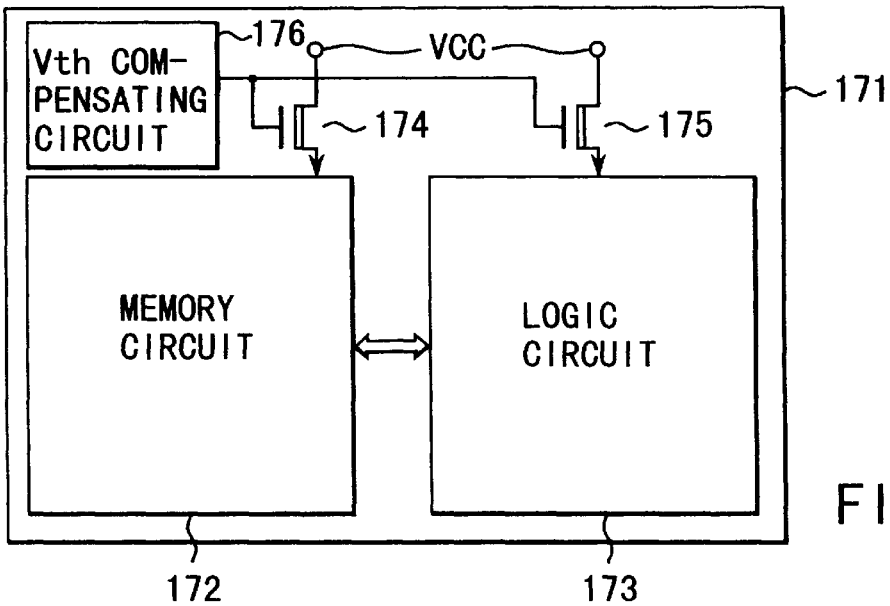
FIG. 17 is a diagram showing the fourth embodiment of the present invention, where the invention is applied to a semiconductor device in which a memory and a logic circuit are mixedly provided.
Figure 18:
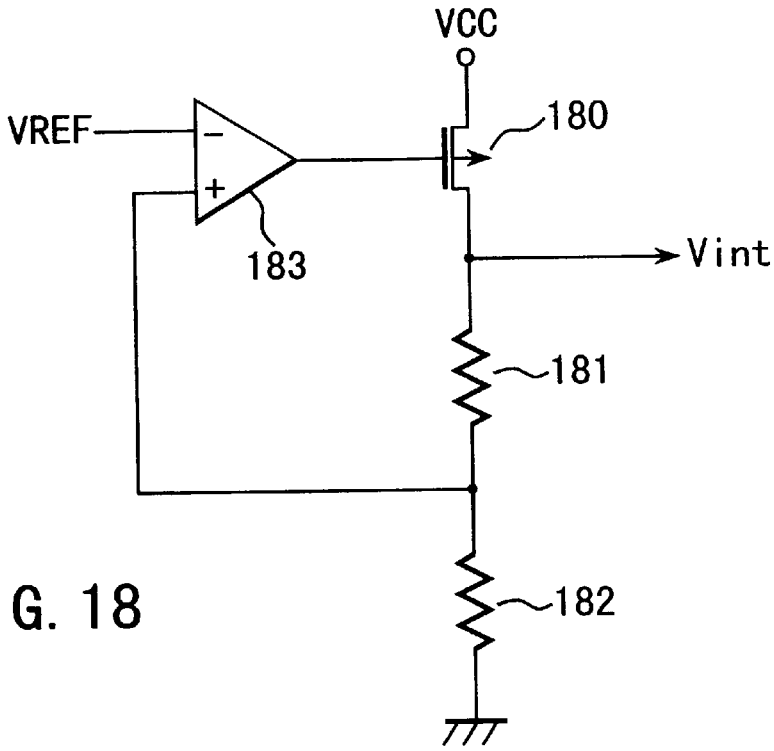
FIG. 18 is a circuit diagram showing an example of the conventional power voltage regulating circuit.
Figure 19:
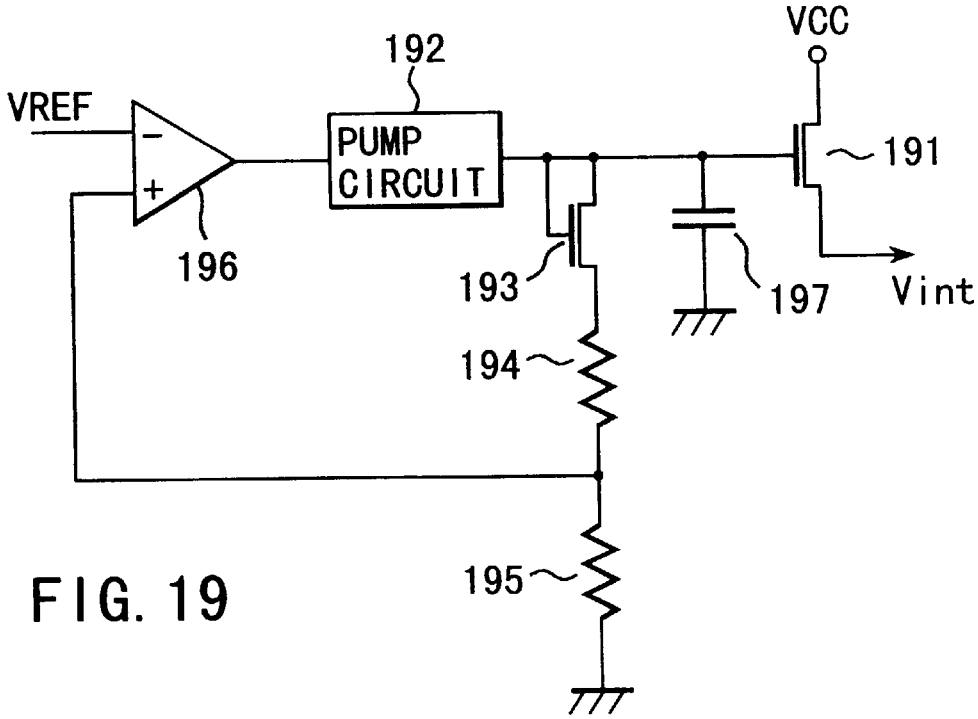
FIG. 19 is a circuit diagram showing another example of the conventional power voltage regulating circuit.
Figure 20:
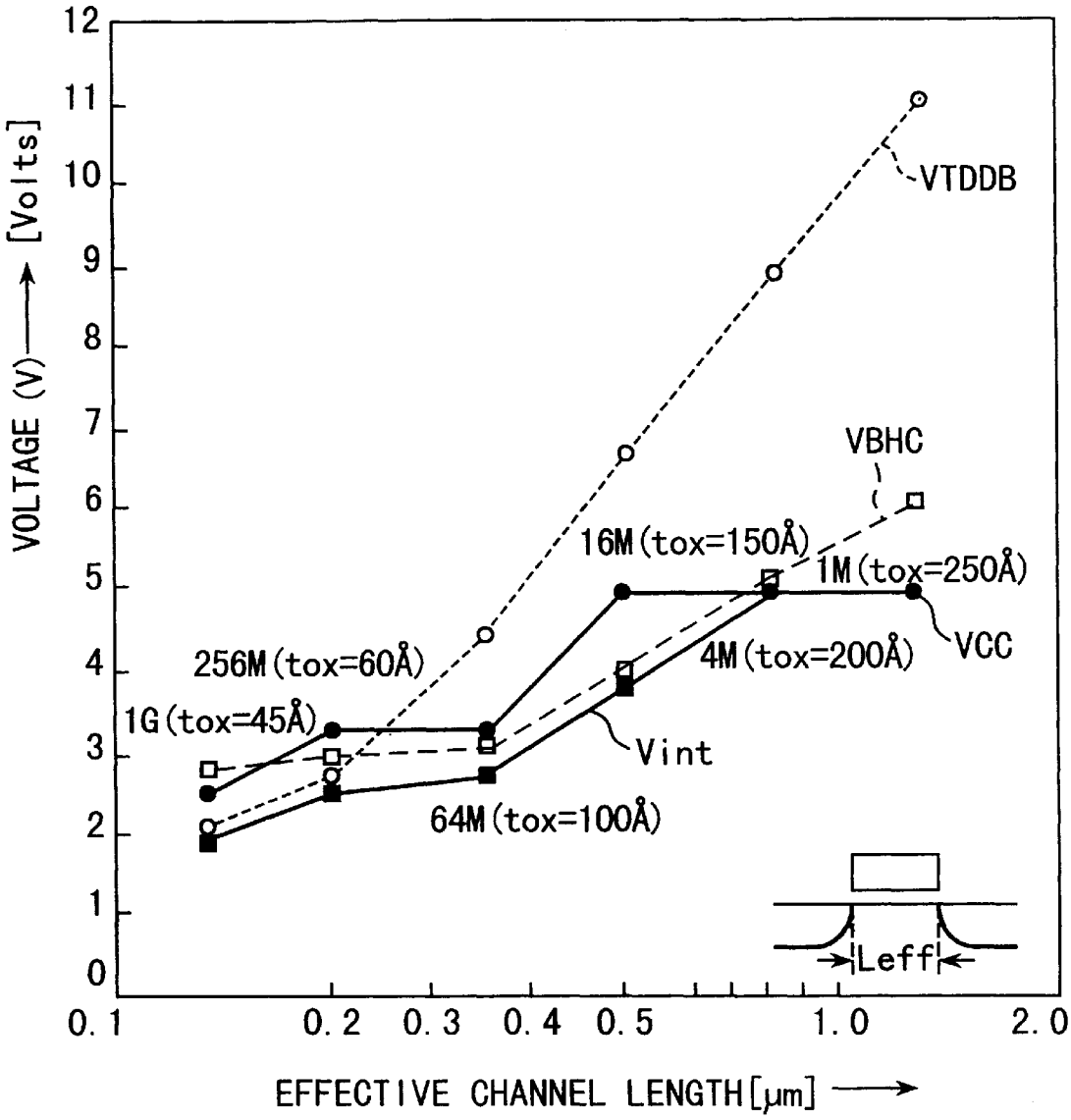
FIG. 20 is a diagram illustrating the relationship between the effective channel length of the transistor, and the power voltage and withstand voltage.

FIG. 17 shows the fourth embodiment of the present invention, which is the case where the invention is applied to a semiconductor device in which a memory and logic circuit are merged. As shown in this figure, a memory circuit 172 made of, for example, DRAM and a logic circuit 173 are provided in a chip 171. Further, a D-type N-channel MOS transistor 174 for lowering a voltage, is connected between the memory circuit 172 and the external power voltage Vcc, and a D-type N-channel MOS transistor 175 for lowering a voltage, is connected between the logic circuit 173 and the external power voltage Vcc. The source of the transistor 175 is connected to the source of the P-channel MOS transistor which constitutes a CMOS logic circuit (not shown), that is, the logic circuit 173. A voltage output from a threshold voltage (Vth) compensating circuit 176 is supplied to the gates of the transistors 174 and 175. The threshold voltage compensating circuit 176 has the same structure as that shown in FIG. 1.

In general, the gate oxide film of the transistor which constitutes the memory circuit 172 is set thicker than the gate oxide film of the transistor which constitutes the logic circuit 173. With this structure, the thickness of the gate oxide film of the transistor which constitutes the memory 172 can be made equal to the thickness of the gate oxide film of the transistor which constitutes the logic circuit 173. Therefore, the memory and logic circuit can share a transistor, thus facilitating the designing and manufacture of the product.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A semiconductor integrated circuit comprising:

a voltage regulating transistor consisting of a depletion-type N channel FET including a current path having one end to which a first voltage is supplied, and an other end connected to an internal circuit; and a control circuit for generating a gate voltage for said voltage regulating transistor, said control circuit supplying the gate voltage to a gate of said voltage regulating transistor, said voltage regulating transistor generating a second voltage lower than the first voltage used in said internal circuit, from said first voltage, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying circuit to operate as an inverse amplifying circuit, said differential amplifying circuit outputting a voltage obtained by compensating the threshold voltage, from the output end thereof.

2. A circuit according to claim 1, wherein a channel length of an FET included in said internal circuit is designed with a rule of 0.2 μm or less.

3. A circuit according to claim 1, wherein said N-channel FET is a source follower having a drain to which a power voltage is supplied, and a source for outputting the second voltage.

4. A semiconductor integrated circuit comprising:

a voltage regulating transistor consisting of a depletion-type N-channel FET including a current path having one end to which a first voltage is supplied, and an other end connected to an internal circuit; and a control circuit for generating a gate voltage for said voltage regulating transistor, and supplying the gate voltage to a gate of said voltage regulating transistor, said voltage regulating transistor generating a second voltage lower than the first voltage used in said internal circuit from said first voltage, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying circuit to operate as an inverse amplifying circuit, said differential amplifying circuit outputting a voltage obtained by compensating the threshold voltage, from the output end thereof.

5. A circuit according to claim 4, wherein a channel length of an FET included in said internal circuit is designed with a rule of 0.2 μm or less.

6. A circuit according to claim 4, wherein said N-channel FET is a source follower having a drain to which a power voltage is supplied, and a source for outputting the second voltage.

7. A semiconductor integrated circuit comprising:

a voltage regulating transistor consisting of a depletion-type N-channel FET including a current path having one end to which an external signal is supplied, and an other end connected to an internal circuit; and a control circuit for generating a gate voltage for said voltage regulating transistor, supplying the gate voltage to a gate of said voltage regulating transistor, said voltage regulating transistor generating an internal signal lower an he external signal used in said internal circuit from said external signal, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, an other input end to which an output voltage of said first current-voltage converting circuit is supplied; and a second current-voltage converting circuit connected between an output end of said differential amplifying circuit and the other input end thereof, for rendering said differential amplifying circuit operate as an inverse amplifying circuit, said differential amplifying circuit outputting a voltage obtained by compensating the threshold voltage, from the output end thereof.

8. A circuit according to claim 7, wherein a channel length of an FET included in said internal circuit is designed with a rule of 0.2 μm or less.

9. A circuit according to claim 8, wherein said N-channel FET is a source follower having a drain to which a power voltage is supplied, and a source for outputting the second voltage.

10. A semiconductor integrated circuit comprising:

a voltage regulating transistor consisting of a depletion-type N-channel FET including a current path having one end to which a first voltage is supplied, and an other end connected to an internal circuit; and a control circuit for generating a gate voltage for said voltage regulating transistor and supplying the gate voltage to a gate of said voltage regulating transistor, said voltage regulating transistor generating a second voltage lower than the first voltage used in an output circuit in accordance with the gate voltage supplied from said control circuit, wherein said output circuit includes:

a first N-channel FET for outputting a low-level voltage for a final stage; and a second N-channel FET inserted between said first N-channel FET and an input/output terminal, and said output circuit serves to supply the second voltage to a gate of said second N-channel FET, wherein said second N-channel FET comprises a depletion-type N-channel FET having a gate to which the second voltage is supplied.

11. A semiconductor integrated circuit comprising:

a voltage regulating transistor consisting of a depletion-type N-channel FET including a current path having one end to which a first voltage is supplied; and a control circuit for generating a gate voltage for said voltage regulating transistor, supplying the gate voltage to a gate of said voltage regulating transistor, said voltage regulating transistor generating a high-level potential of a word line lower than said first voltage, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying circuit to operate as an inverse amplifying circuit, said differential amplifying circuit outputting a voltage obtained by compensating the threshold voltage, from the output end thereof.

12. A circuit according to claim 11, wherein said N-channel FET has a drain to which a power voltage is supplied, and a source for outputting the second voltage.

13. A semiconductor integrated circuit comprising:

a memory circuit provided in a chip;

a logic circuit arranged in said chip;

a first voltage regulating transistor consisting of a depletion-type N-channel FET including a current path having one end to which a first voltage is supplied, and an other end connected to said memory circuit;

a second voltage regulating transistor consisting of a depletion-type N-channel FET including a current path having one end to which the first voltage is supplied, and an other end connected to said logic circuit; and a control circuit for generating gate voltages for said first and second voltage regulating transistors and supplying the gate voltages to gates of said first and second voltage regulating transistors, said first and second voltage regulating transistors generating second voltages used in said memory circuit and said logic circuit, respectively, from said first voltage, in accordance with the gate voltage supplied from said control circuit, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying circuit to operate as an inverse amplifying circuit, said differential amplifying circuit outputting a voltage obtained by compensating the threshold voltage, from the output end thereof.

14. A circuit according to claim 13, wherein said control circuit further comprises:

a depletion-type N-channel FET including a current path having one end to which a first voltage is supplied, and a gate to which the reference voltage is supplied; and a resistance inserted between an other end of the current path of the transistor, and said reference voltage.

15. A semiconductor integrated circuit comprising:

a voltage regulating transistor consisting of a depletion-type N-channel FET including a current path having one end to which a first voltage is supplied;

a detection circuit, containing a depletion-type N-channel FET, for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying circuit to operate as an inverse amplifying circuit, said differential amplifying circuit outputting a voltage obtained by compensating the threshold voltage, from the output end thereof.

16. A circuit according to claim 15, wherein said differential amplifying circuit has an amplifier provided between said output terminal and said second current-voltage converting circuit.

17. A circuit according to claim 15, wherein said first and second current-voltage converting circuits have resistances of the same resistance value.

18. A semiconductor integrated circuit comprising:

a voltage regulating transistor consisting of a depletion-type N-channel FET including a current path having one end to which a first voltage is supplied, and an other end for outputting a second voltage for the semiconductor integrated circuit; and a control circuit for generating a gate voltage on a basis of reference voltage, and supplying the compensated gate voltage to a gate of said voltage regulating transistor, said gate voltage obtained by compensating a process and a temperature variation in threshold voltage of said voltage regulating transistor, wherein said control circuit further comprises:

a detection circuit for detecting a threshold voltage of said voltage regulating transistor;

a first current-voltage converting circuit for converting a current corresponding to the threshold voltage detected by said detection circuit, into a voltage;

a differential amplifying circuit having an input end to which a reference voltage is supplied, and an other input end to which an output voltage of said first current-voltage converting circuit is supplied; and a second current-voltage converting circuit connected between an output end of said differential amplifying circuit and the other input end thereof, for rendering said differential amplifying Circuit operate as an inverse amplifying circuit, said differential amplifying circuit outputting a voltage obtained by compensating the threshold voltage, from the output end thereof.

19. A circuit according to claim 18, wherein said control circuit further comprises:

a detection circuit for detecting a variation in the threshold voltage of said voltage regulating transistor, with reference to the reference voltage; and an inverse amplifying circuit for generating a gate voltage of said voltage regulating transistor, by inverting an output voltage detected by said detection circuit.

20. A circuit according to claim 1, wherein said second current-voltage converting circuit having a converting rate equal to that of said first current-voltage converting circuit.

21. A circuit according to claim 4, wherein said second current-voltage converting circuit having a converting rate equal to that of said first current-voltage converting circuit.

22. A circuit according to claim 11, wherein said second current-voltage converting circuit having a converting rate equal to that of said first current-voltage converting circuit.

23. A circuit according to claim 13, wherein said second current-voltage converting circuit having a converting rate equal to that of said first current-voltage converting circuit.

24. A circuit according to claim 15, wherein said second current-voltage converting circuit having a converting rate equal to that of said first current-voltage converting circuit.

25. A circuit according to claim 3, wherein said first voltage is an external power voltage, and said second voltage is an internal power voltage.

26. A circuit according to claim 6, wherein said first voltage is an external power voltage, and said second voltage is an internal power voltage.

27. A circuit according to claim 10, wherein said first voltage is an external power voltage, and said second voltage is an internal power voltage.

28. A circuit according to claim 12, wherein said first voltage is an external power voltage, and said second voltage is an internal power voltage.

29. A circuit according to claim 14, wherein said first voltage is an external power voltage, and said second voltage is an internal power voltage.

30. A circuit according to claim 15, wherein said first voltage is an external power voltage, and said second voltage is an internal power voltage.

31. A circuit according to claim 18, wherein said first voltage is an external power voltage, and said second voltage is an internal power voltage.

32. A semiconductor integrated circuit comprising:

a voltage regulating transistor consisting of a depletion-type N-channel FET including a current path having one end to which a first voltage is supplied, and an other end connected to an internal circuit; and a control circuit for generating a gate voltage for said voltage regulating transistor, said control circuit supplying the gate voltage to a gate of said voltage regulating transistor, said voltage regulating transistor generating a second voltage lower than the first voltage used in said internal circuit, from said first voltage, wherein said control circuit further comprises:

a detection circuit for detecting a threshold voltage of said voltage regulating transistor, a differential amplifying circuit having an input end to which a reference voltage is supplied, and an other input end to which a voltage corresponding to an output voltage of said detection circuit is supplied, said differential amplifying circuit outputting a voltage compensating for the variations in the threshold voltage of said voltage regulating transistor.

33. A circuit according the claim 32, further comprising a first current-voltage converting circuit for converting a current corresponding to the threshold voltage detected by the detection circuit, into a voltage, and supplying the voltage to the other input end of the differential amplifying circuit.

34. A circuit according to claim 33, further comprising a second current-voltage converting circuit connected between the output end of said differential amplifying circuit and the other input end thereof, for rendering said differential amplifying circuit operate as an inverse amplifying circuit, said differential amplifying circuit outputting a voltage obtained by compensating the threshold voltage, from the output end thereof.

35. A circuit according to claim 34, wherein said second current-voltage converting circuit having a converting rate equal to that of said first current-voltage converting circuit.

* * * * *

UNITED STATES PATENT AND TRADEMARK OFFICE

CERTIFICATE OF CORRECTION

PATENT NO. : 6,229,384 B1
DATED : May 8, 2001
INVENTOR(S) : Takashi Ohsawa

It is certified that error appears in the above-identified patent and that said Letters Patent is hereby corrected as shown below:

Column 19, claim 7,
Line 54, "an he" has been replaced with -- than the --.

Column 22, claim 18,
Line 34, "Circuit" has been replaced with -- circuit --.

Signed and Sealed this

Eighth Day of January, 2002

*Attest:*

*Attesting Officer*

JAMES E. ROGAN
*Director of the United States Patent and Trademark Office*